US011859395B2

(12) United States Patent
Del Real et al.

(10) Patent No.: US 11,859,395 B2
(45) Date of Patent: Jan. 2, 2024

(54) RIDING TROWEL HAVING ROTORS CONFIGURED FOR REVERSE ROTATION

(71) Applicant: Multiquip, Inc., Cypress, CA (US)

(72) Inventors: Erick M. Del Real, Meridian, ID (US); Larry Jake Chapple, Boise, ID (US); Nathaniel Cody Bateman, Boise, ID (US); Jeffrey Kevin Davis, Boise, ID (US)

(73) Assignee: Multiquip, Inc., Cypress, CA (US)

( * ) Notice: Subject to any disclaimer, the term of this patent is extended or adjusted under 35 U.S.C. 154(b) by 52 days.

(21) Appl. No.: 17/543,722

(22) Filed: Dec. 6, 2021

(65) Prior Publication Data

US 2022/0090397 A1 Mar. 24, 2022

Related U.S. Application Data

(63) Continuation of application No. 16/752,598, filed on Jan. 24, 2020, now Pat. No. 11,193,286.

(60) Provisional application No. 62/796,529, filed on Jan. 24, 2019.

(51) Int. Cl.
*E04F 21/24* (2006.01)
*E01C 19/42* (2006.01)

(52) U.S. Cl.
CPC ..... *E04F 21/247* (2013.01); *E01C 19/42* (2013.01)

(58) Field of Classification Search
CPC ..... E01F 21/247; E01C 19/42
USPC ..... 404/84.05–84.5, 112, 117
See application file for complete search history.

(56) References Cited

U.S. PATENT DOCUMENTS

| | | | | |
|---|---|---|---|---|
| 5,584,598 | A | 12/1996 | Watanabe et al. | |
| 5,685,667 | A | 11/1997 | Allen | |
| 5,816,740 | A | 10/1998 | Jaszkowiak | |
| 6,106,193 | A | 8/2000 | Allen et al. | |
| 6,368,016 | B1 | 4/2002 | Smith et al. | |
| 7,232,277 | B2 | 6/2007 | Corbitt | |
| 8,132,983 | B2 | 3/2012 | Lutz et al. | |
| 8,388,264 | B2 | 3/2013 | Grahl | |
| 8,708,598 | B2 | 4/2014 | Hanson et al. | |
| 8,998,531 | B2 | 4/2015 | Hanson et al. | |
| 9,631,378 | B1 | 4/2017 | Grahl et al. | |
| 2004/0022581 | A1 | 2/2004 | Corbitt | |
| 2005/0220541 | A1* | 10/2005 | Corbitt | E04F 21/245 404/112 |
| 2011/0033235 | A1 | 2/2011 | Leggitt et al. | |
| 2013/0129419 | A1* | 5/2013 | Hanson | E01C 19/42 404/112 |

(Continued)

*Primary Examiner* — Raymond W Addie
(74) *Attorney, Agent, or Firm* — Burdick Patents, P.A.; Sean D. Burdick; Colin L. Honan

(57) ABSTRACT

A self-propelled power trowel for finishing a concrete surface is equipped with reversible rotors to allow an operator to reverse the direction of rotation of rotor blades. The trowel includes a rigid frame adapted for operation over a concrete surface, a pair of rotor assemblies having rotor blades tiltably connected to the rigid frame for frictionally contacting the concrete surface and supporting the rigid frame thereabove, a prime mover mounted to the rigid frame and operatively coupled to drive the rotor blades of the rotor assemblies in opposite rotational directions. Synchronous or hydraulic motors are configured for causing, responsive to manual controls, reversal of the direction of rotation of the rotor blades.

17 Claims, 24 Drawing Sheets

(56) References Cited

U.S. PATENT DOCUMENTS

| | | | | |
|---|---|---|---|---|
| 2015/0093195 | A1* | 4/2015 | Fielder | E04F 21/247<br>404/112 |
| 2018/0030672 | A1* | 2/2018 | Marsolek | E01C 19/42 |
| 2018/0316868 | A1* | 11/2018 | Tschirhart | H04N 7/183 |
| 2019/0238083 | A1 | 8/2019 | White et al. | |

* cited by examiner

RIDING TROWEL HAVING ROTORS CONFIGURED FOR REVERSE ROTATION

RELATED APPLICATIONS

This application is a continuation of and claims priority to U.S. patent application Ser. No. 16/752,598 filed Jan. 24, 2020, which is a continuation-in-part of and claims priority to U.S. Provisional Application 62/796,529 filed Jan. 24, 2019, both of which are fully incorporated herein by reference.

FIELD OF THE INVENTION

The present invention relates generally to power trowels for finishing concrete surfaces such as floors, more specifically to self-propelled ride-on trowels, and most specifically to a drive train for a self-propelled ride-on trowel having dual counter-rotating rotors.

BACKGROUND OF THE INVENTION

Self-propelled riding trowels are well-known in the art. Such trowels are used in concrete finishing operations typically on large-scale pours to allow an operator to finish vast areas of concrete quickly and efficiently. An on-board engine typically serves as the prime mover for the riding trowel. Other components of the drive train, which may be hydraulic or electric, couple the mechanical energy of the engine to rotor assemblies at the base of the trowel that provide both the motive force for moving the trowel and also the means for finishing the concrete surface beneath the trowel.

State-of-the-art riding trowels may be equipped with manual controls, such as one or more joysticks, to allow a seated operator to cause movement of the trowel over the surface of the concrete pour by directional manipulation of a joystick. The rotor assemblies, typically dual rotor assemblies, are configured for counter-rotation, that is, to rotate in opposite directions for stability. Electronic controls translate directional manipulation of manual controls into mechanical adjustment of rotor speed and pitch, to cause corresponding directional movement of the riding trowel.

The rotor assemblies and the controls therefor are configured to cause each rotor to turn always in the same rotational direction. In most if not all cases, from the perspective of an operator seated on the trowel and looking forward, the left rotor is configured to rotate clockwise and the right trowel is configured to rotate counter-clockwise. This mode of counter-rotation tends to draw debris collected or generated from the concrete surface by action of the trowel blades backward and between the two rotors. When an operator is working within the perimeter of a pour, this scheme makes little or no difference, as the operator has plenty of spatial freedom to smooth out any surface irregularities caused by the debris. At the perimeter of a pour, however, it is undesirable to pull the debris away from the edge and backward between the rotors due to spatial constraints at the edge that restrict trowel access. Skilled operators working near the perimeter of a pour therefore operate the trowel in reverse. Approaching the edge in a reverse direction essentially reverses the mode of counter-rotation, so that, from the perspective of an operator looking backward, the left rotor rotates counter-clockwise and the right rotor rotates clockwise. This mode tends to push debris outward to the perimeter, to confine the build-up of debris at or near the edge of the pour where it can be treated without disturbing the finished interior.

There are however, inherent difficulties when operating a riding trowel in reverse. Foremost among these is a diminished field of vision that an operator of any moving vehicle will experience when turning his neck around to look behind. The probability of a manual control error also rises when an operator contorts his upper body in such a manner. And over time, an operator who periodically cranes his neck to reverse his field of vision while operating heavy equipment will tend to suffer neck, arm, or back injuries. An operator who has already sustained a neck injury or some other condition that limits his ability to rotate his neck may no longer be able to operate a riding trowel, due to his inability to approach the perimeter of a pour in reverse. What is needed is an advancement in the design of riding trowels that obviates the need for an operator to reverse his field of vision.

SUMMARY OF THE INVENTION

The foregoing problems are overcome by a riding trowel having rotors configured for reverse rotation. In one embodiment according to the present invention, a self-propelled power trowel is designed for finishing a concrete surface, and includes rigid frame means adapted for operation over the concrete surface. Each of a pair of rotor assemblies is equipped with rotor blades for frictionally contacting the concrete surface and supporting the frame means thereabove. Each rotor assembly is tiltably connected to the rigid frame means. A prime mover is mounted to the rigid frame means and is operatively coupled to the rotor assemblies. The trowel includes a means for rotating the rotor blades in opposite directions, and a means for reversing direction of rotation of the rotor blades.

More elaborate embodiments of the present invention are also disclosed and provide various additional features and controls for a riding trowel having rotors configured for reverse rotation. For example, in one embodiment, a self-propelled power trowel has all of the foregoing features, and in addition, the means for reversing direction of the rotor blades comprises solid state logic. In another embodiment, the means for reversing direction of rotation of the rotor blades comprises one or more hydraulic valves. In another embodiment, the means for reversing direction of rotation of the rotor blades comprises operator pushbutton controls. In another embodiment, the self-propelled power trowel includes a user input display configured to display indication of reverse rotation of the rotor blades responsive to actuation of the reversing means. Other embodiments include invertible steering controls that cause forward movement of the trowel responsive to a forward demand from an operator regardless of the direction of rotation of the rotor blades, or that cause rearward movement of the trowel responsive to a rearward demand from an operator regardless of the direction of rotation of the rotor blades.

Further embodiments of the present invention may be based on any of the foregoing embodiments, and also include a foot pedal and push button, wherein the foot pedal is electrically and mechanically configured to set rotational speed of the rotor blades responsive to actuation of the foot pedal by an operator, and wherein the push button is electrically and mechanically configured to lock the set rotational speed responsive to actuation of the push button by the operator. A user input display may be added to the power trowel, and may be configured to display indication of rotor speed responsive to actuation of the foot pedal.

Programmable controls may be included to allow the operator to set a desired maximum rotational speed for the rotor blades, wherein the maximum speed corresponds to full actuation of the foot pedal. In another embodiment, the programmable controls are further configured to provide higher resolution of desired speed within a range of speeds between a minimum speed and said maximum speed.

In another embodiment, a self-propelled power trowel for finishing a concrete surface includes the following features: a rigid frame means adapted to operate over the concrete surface, a pair of rotor assemblies each having rotor blades for frictionally contacting the concrete surface and supporting the rigid frame means thereabove, a prime mover mounted to the rigid frame means and operatively coupled to the rotor assemblies, means for rotating the rotor blades in opposite directions, means for moving the trowel in forward and reverse directions, a rear facing video camera, and a user input display that displays a video signal from the rear facing camera responsive to moving the trowel in the reverse direction.

In another embodiment, a self-propelled power trowel for finishing a concrete surface has the following features: a rigid frame means adapted for operation over the concrete surface, a power source for providing power to the power trowel and attached to the rigid frame means, a pair of rotor assemblies for frictionally contacting the concrete surface and supporting said rigid frame means thereabove, motor means operatively connected to the power source for driving the rotor assemblies, and an energy storage means coupled to or in communication with the motor means and configured to discharge energy to assist the motor means in driving a required load. In another embodiment, the motor means may include one or more electric motors, and the energy storage means may include one or more capacitors. In another embodiment, the motor means include one or more hydraulic actuators and the energy storage means may include one or more accumulators.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The present invention provides an advancement in self-propelled power trowel design that gives an operator of a riding trowel the ability to reverse the direction of rotation of the rotors. The invention is particularly useful when the power trowel approaches the edge of a pour, so that the operator can maintain a forward perspective while causing the rotors to urge concrete finishing debris to the perimeter of the pour. While the present invention may be employed on a trowel powered by gas, diesel, hydraulic, or electrical power, for simplicity and purposes of illustration only, the present disclosure primarily describes an embodiment of the invention installed on a self-propelled rising trowel equipped with a hybrid drive train that uses synchronous AC motors to drive the trowel rotors.

Figure 1:
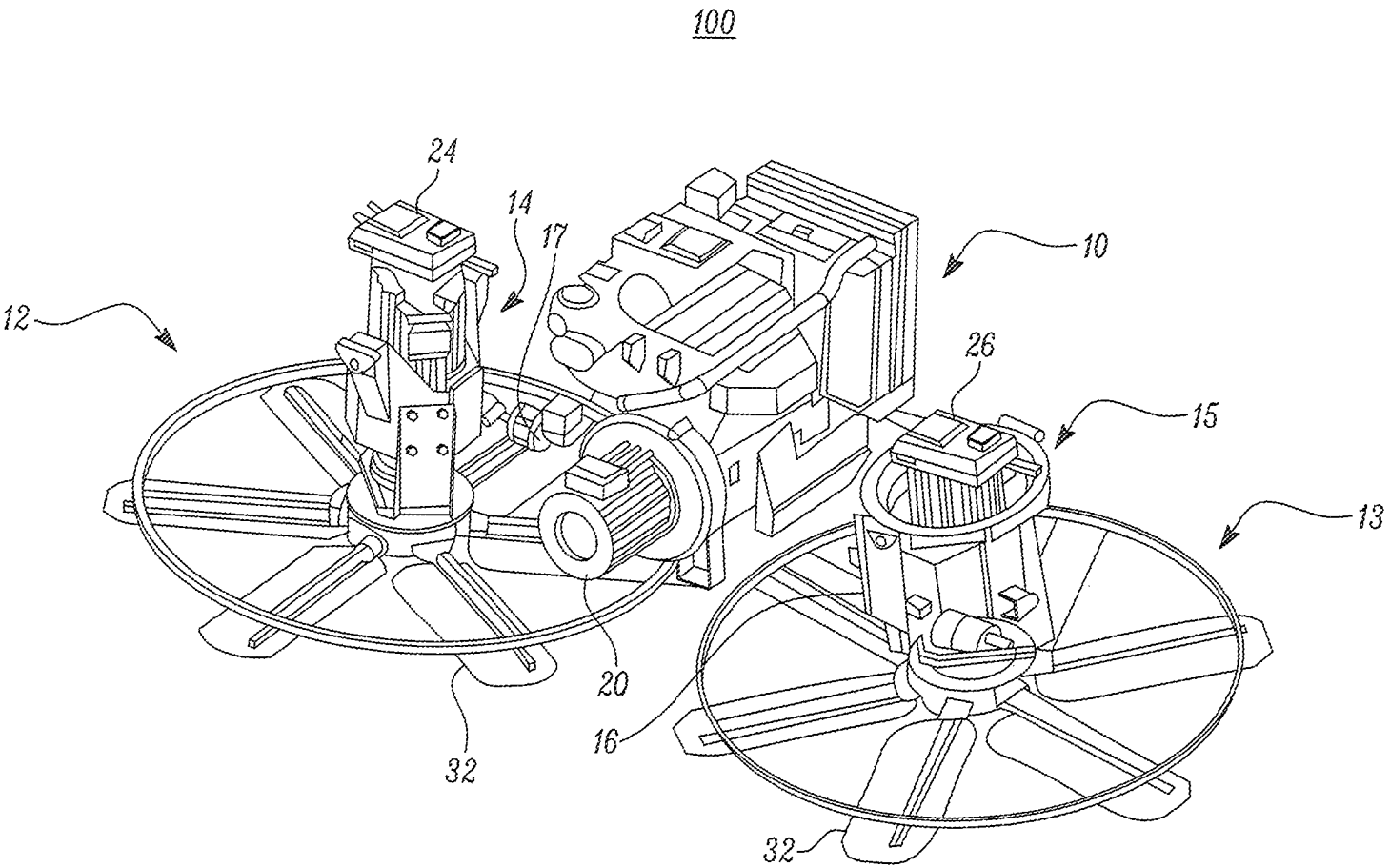
FIG. 1 is a perspective view of one embodiment of a self-propelled power trowel having rotors configured for reverse rotation according to the invention.

FIG. 1 shows a perspective view of one embodiment of a self-propelled power trowel according to the invention. The drive train is mounted to a rigid frame 60 in a manner known in the art and depicted, for example, in U.S. Pat. No. 8,998,531, which is fully incorporated herein by reference. For simplicity and ease of illustration, the rigid frame is omitted from the figures herein. The main components of the hybrid drive train 100 include an electrical power source 10, a pair of rotatable rotor assemblies 12, 13, electric motors 14, 15 operatively connected between the electrical power source 10 and the rotatable rotor assemblies 12, 13, respectively, a set of actuators 17 configured for tilting the rotor assemblies 12, 13, and a set of pitch actuators 16.

The electrical power source 10 is attached to the rigid frame and provides electric power to the power trowel. Power source 10 is preferably configured to output DC power for input to 3-phase inverters 24, 26 that drive AC motors 14, 15 of the rotor assemblies 12, 13. In one embodiment, the DC power is obtained by mechanically coupling a 3-phase AC electrical generator 20 to an internal combustion engine 18. The output of the AC generator 20 is then coupled to a DC rectifier 22. In another embodiment, the DC power may be obtained solely from a battery, or from the combination of a battery 28 and battery charger 30.

The rotor assemblies 12, 13 each comprise a set of rotatable trowel blades 32, that are tiltably connected to the rigid frame of the power trowel. The rotatable trowel blades 32 are disposed at the bottom of the power trowel and are configured for making frictional contact with a concrete surface. Pitch actuators 16, one per rotor assembly, are configured to rotate the trowel blades 32 about a center axis of the trowel arms to adjust the pitch angle of each blade 32. The rotor assemblies 12, 13 are thus configured to support the rigid frame above the concrete surface. The rotor assemblies 12, 13 are each coupled, respectively, through a gearbox 52 to the shaft of the corresponding AC motor 14 or 15. These motors are each operatively connected to the electrical power source 10, so that energization thereby of the motors 14 and 15 causes rotation of the trowel blades 32 across the concrete surface. In other embodiments of riding trowels, hydraulic actuators, rather than electric motors, can be used to set the direction of rotation of each rotor.

Figure 2:
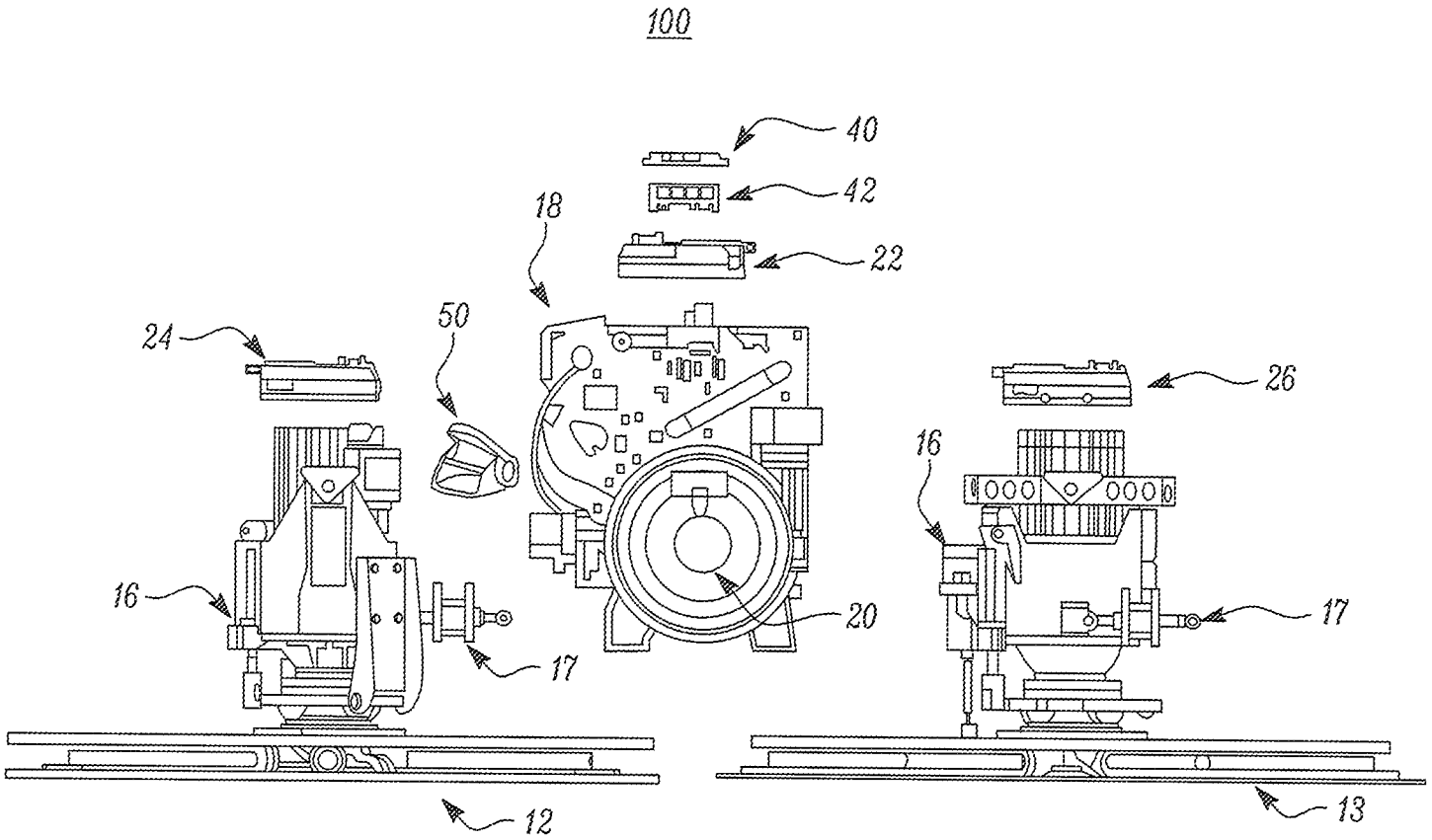
FIG. 2 is an exploded view of various components in one embodiment of a self-propelled power trowel having rotors configured for reverse rotation according to the invention.

The hybrid drive train 100 includes at least three means for tilting the rotor assemblies 12, 13 with respect to the rigid frame, to cause movement of the power trowel across the surface of the concrete floor. The tilting action of each of the tilting means is best described relative to the front and rear ends of the power trowel and to a center line running centrally through the power trowel from the front end to the rear end. For purposes of illustration, the front and rear ends and the centerline can be defined by the location of the electrical generator 20. FIGS. 1 and 2 show the electrical generator 20 mounted at the front end of the power trowel. The end opposite the mounting location of the electrical generator 20 is the rear end of the power trowel, and the centerline is an imaginary line that runs from the rear end to the front end along the central axis of the electrical generator 20.

In one embodiment, one of the means for tilting a rotor assembly 12 or 13 may be a steering actuator 17 that is operably interconnected between the rigid frame and a rotor assembly 12 or 13. This configuration allows each rotor assembly 12 or 13 to be tilted fore and aft, about an axis that is substantially perpendicular to the centerline of the rigid frame. This action, combined with frictional rotation of the trowel blades 32, causes the power trowel to move from side to side along the concrete surface. The second and third means for tilting a rotor assembly 12 or 13 may be a steering actuator 17 operatively interconnected between the rigid frame and each rotor assemblies 12, 13 for selectively and independently tilting the rotor assemblies toward and away from the centerline of the rigid frame, about an axis that is substantially parallel to the centerline. This action, combined with the frictional rotation of the trowel blades 32, causes the power trowel to move forward or backward along the concrete surface. The steering actuators 17 may be hydraulic, pneumatic, or electric actuators. While the axes about which the rotor assemblies tilt have been described as substantially perpendicular or substantially parallel with respect to the centerline, other orientations of the tilt axes are possible without departing from the scope of the invention.

FIG. 2 shows an exploded view of various components in one embodiment of an assembly for the hybrid drive train 100. Again, the rigid frame is omitted. In this embodiment, the engine 18 and generator 20 are coupled together and mounted in a central location on the power trowel. Electrical control modules including an engine control unit (ECU) 40, a machine control unit (MCU) 42, and a generator controller 22 are mounted at accessible locations atop or adjacent to the engine 18 and generator 20. The rotor assemblies 12 and 13 are mounted on either side of the centerline in a symmetrical configuration so that the center of mass of the power trowel occurs near the centerline. Motor controllers 24 and 26 for controlling power input to motors 14 and 15, respectively, are located adjacent to either motor 14 or 15, or in another convenient location. A User Input Display 50 may be mounted to the rigid frame at a convenient location for an operator.

Figure 3:
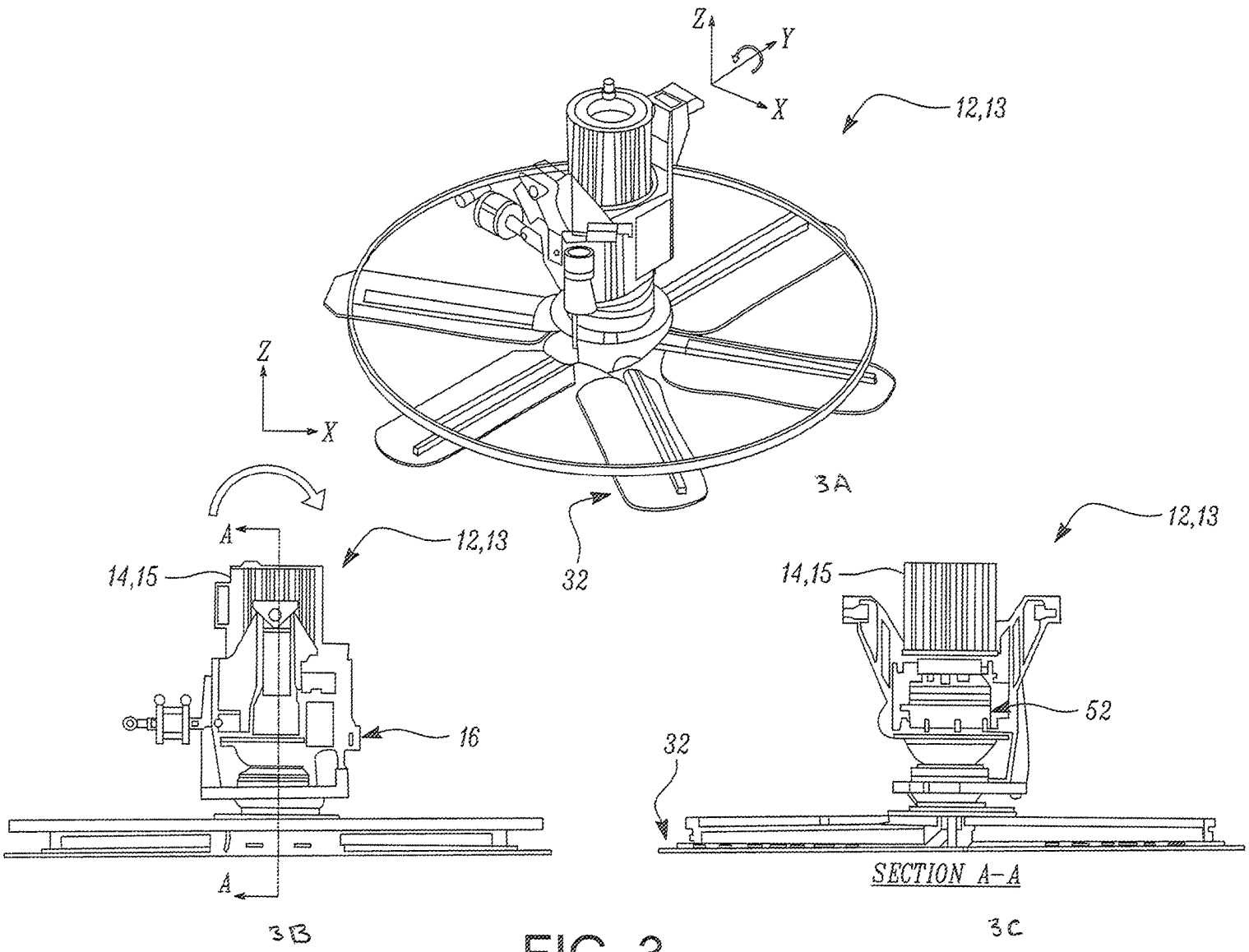
FIG. 3 shows three views (3A, 3B, 3C) of an embodiment of a rotor assembly for a self-propelled power trowel having rotors configured for reverse rotation according to the invention.

FIG. 3 shows three views (FIG. 3A, FIG. 3B, FIG. 3C) of a rotor assembly 12 or 13 to better illustrate a means for tilting the rotor assembly. In these views, the rotor assembly 12 or 13 is configured for a single degree of rotational freedom. The three views are a perspective view, a side view, and a cross sectional side view taken along Section A-A, as shown. The axes x, y, and z establish orthogonal coordinates for purposes of illustration. The x-axis runs in a horizontal side-to-side direction perpendicular to the centerline of the power trowel. The y-axis runs in a horizontal fore-to-aft direction parallel to the centerline. The z-axis runs in a vertical direction perpendicular to the x-axis and y-axis. The coordinate axes in the perspective view indicate that this rotor assembly 12 or 13 is configured for one rotational degree of freedom about the y-axis.

Figure 4:
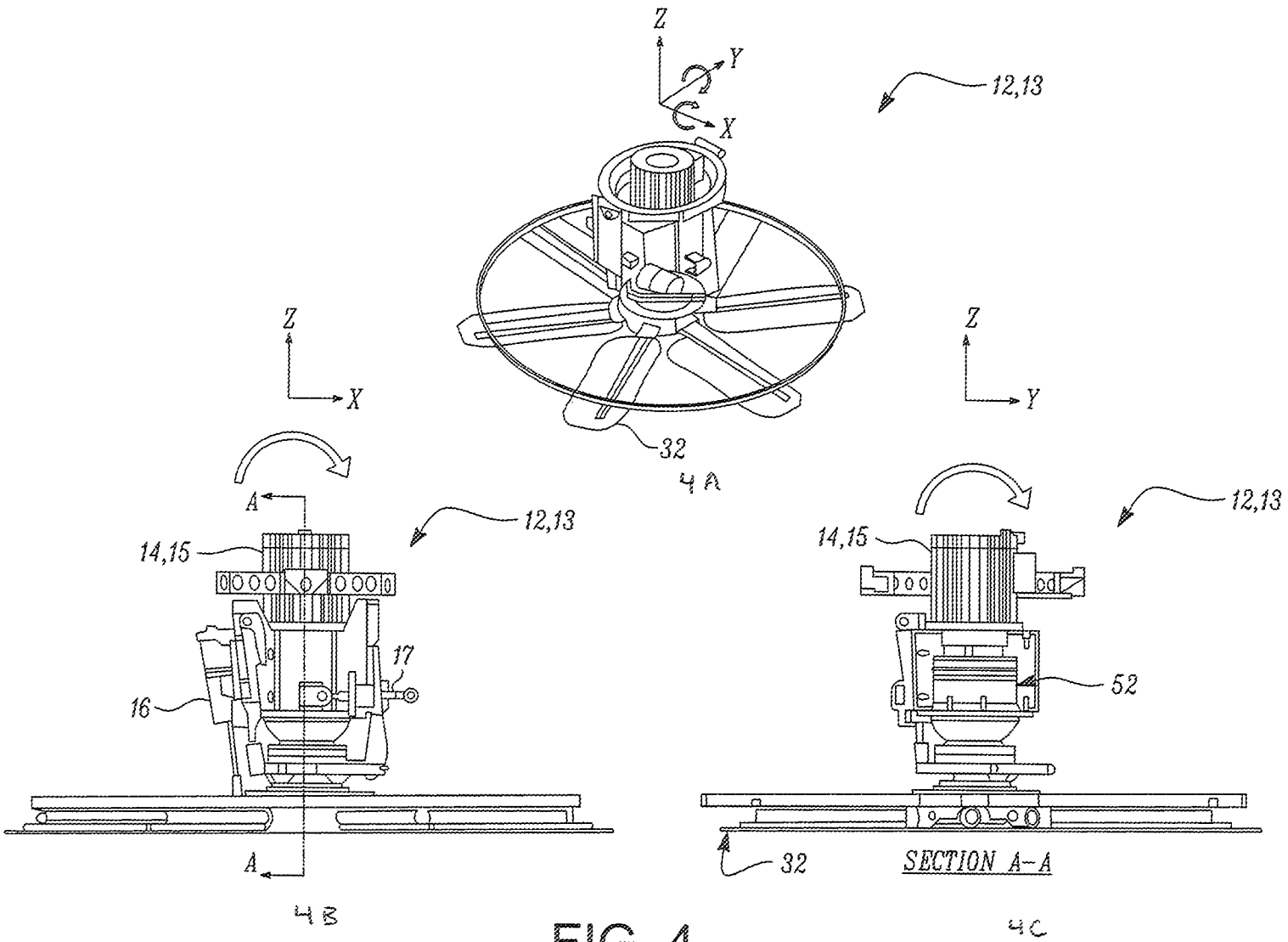
FIG. 4 shows three views (4A, 4B, 4C) of another embodiment of a rotor assembly for a self-propelled power trowel having rotors configured for reverse rotation according to the invention.

FIG. 4 shows another three views (FIG. 4A, FIG. 4B, FIG. 4C) of a rotor assembly 12 or 13 to illustrate a means for tilting the rotor assembly configured for two degrees of rotational freedom. The three views are a perspective view, a side view, and a cross sectional side view taken along Section A-A, as shown, with coordinate axes x, y, and z indicated as in FIG. 3. The coordinate axes in the perspective view indicate that this rotor assembly 12 or 13 is configured for two rotational degrees of freedom about both the x-axis and the y-axis.

The two degrees of rotational freedom are provided by means of steering actuators 17 in a similar fashion to the single degree of rotational freedom as previously described. The steering actuator 17 is configured to tilt rotor assembly 12 or 13 with respect to the rigid frame about the x and y axes. The lower right figure also shows the trowel blades 32 of the rotor assembly rotatably connected through a gearbox 52 to the motor 14 or 15.

Figure 5:
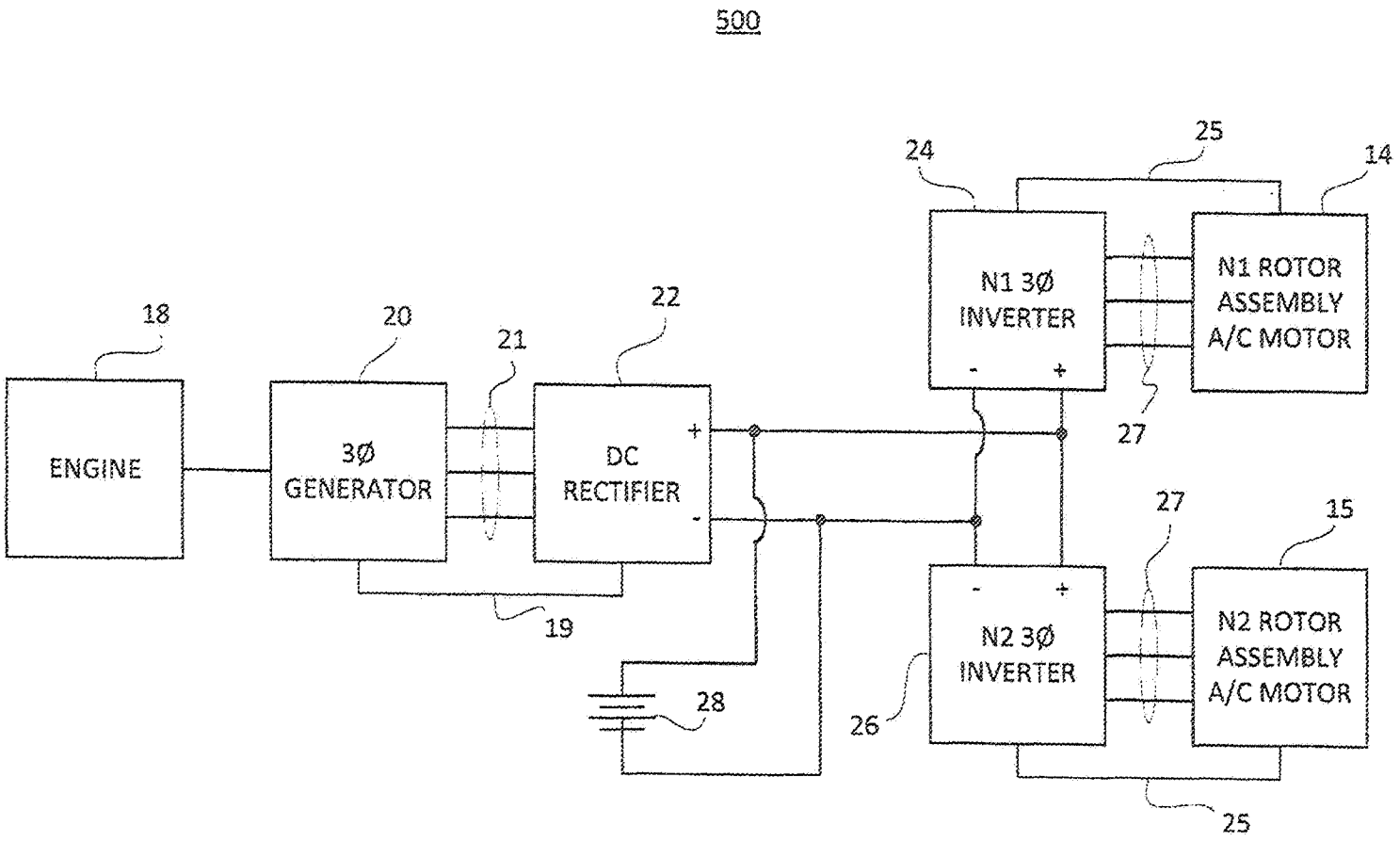
FIG. 5 is a block diagram of one embodiment of a drive train for a self-propelled power trowel having rotors configured for reverse rotation according to the invention.

FIG. 5 is a block diagram of one embodiment 500 of a hybrid drive train for a self-propelled power trowel according to the invention. The main components of the hybrid drive train 500 include an engine 18, a 3-phase electric generator 20, a DC rectifier 22, 3-phase inverters 24, 26 (the "N1" and "N2" inverters), and AC motors 14, 15 for the "N1" and "N2" rotor assemblies. An optional DC battery 28 may be connected across the input terminals of the inverters 24, 26. The bulkier components such as the engine 18 are mounted directly to the rigid frame of the power trowel. Other components may also be mounted to the rigid frame, or may be mounted directly to one of the bulkier components. In this embodiment, the combination of engine 18, generator 20, and rectifier 22 serves as the electrical power source 10 described above.

Engine 18 is the prime mover for the drive train of the power trowel. Engine 18 is preferably a gasoline or diesel engine, but it may also run on other fuel sources. For example, one embodiment of the power trowel may employ a Ford model MSG 425 2.5-liter gasoline, natural gas, or liquefied petroleum gas engine. Another, lighter duty embodiment of the power trowel may comprise a Ford model TSG-415 1.5-liter engine. Other makes and models of engines may be used as engine 18, depending on the scale of the power trowel and the desired fuel source. In the drive train, the engine 18 is mechanically coupled to the generator 20 to provide mechanical energy thereto.

Generator 20 comprises a 3-phase AC electrical generator that converts the mechanical energy of the engine 18 into electrical power. The size of the generator 20 may be selected according to the power requirements of the drive train. In one embodiment, generator 20 is a Parker Hannifin model GVM-210-100, permanent magnet liquid-cooled synchronous AC motor, having a peak output torque rating of 168 Nm, and having a maximum peak power rating of 142 kW. Generator 20 may be coupled to the rectifier 22 by a resolver cable 19 for purposes of feedback control. Another embodiment would use an encoder for feedback control. The electrical output of the generator 20 is transmitted by 3-phase power cable 21 to the DC rectifier 22. The DC rectifier 22 converts the 3-phase AC power to a DC voltage. An optional battery 28 may be connected across the terminals of the DC rectifier 22, to assist in supplying power to motors 14, 15 during periods of high demand, and to absorb energy in the event of back emf. In one embodiment, the DC rectifier may comprise a Sevcon voltage-matched inverter compatible with GVM series motors and operating in rectifier mode.

The DC power output from DC rectifier 22 is coupled to the input terminals of each of two 3-phase inverters 24, 26, which correspond to the left (N1) and right (N2) rotor assemblies 12, 13. The inverters 24, 26 may each comprise a Sevcon voltage-matched inverter compatible with GVM series motors. The power output from each inverter 24, 26 is supplied via 3-phase power cables 27 to an AC motor 14 or 15, respectively. Each inverter 24, 26 may be coupled to its corresponding AC motor 14, 15 by a resolver or encoder cable 25 for purposes of feedback control.

Motors 14, 15 are preferably identical models. Each motor 14, 15 preferably comprises a 3-phase, brushless, synchronous AC motor that provide the motive force for rotor assemblies 12, 13. The size of the motors 14, 15 may be selected according to the power requirements of the drive train. In one embodiment, each motor 14, 15 is a Parker Hannifin model GVM-210-075X, permanent magnet liquid-cooled synchronous AC motor, having a peak output torque rating of 82 Nm, and having a peak power rating of 23 kW.

Figure 6:
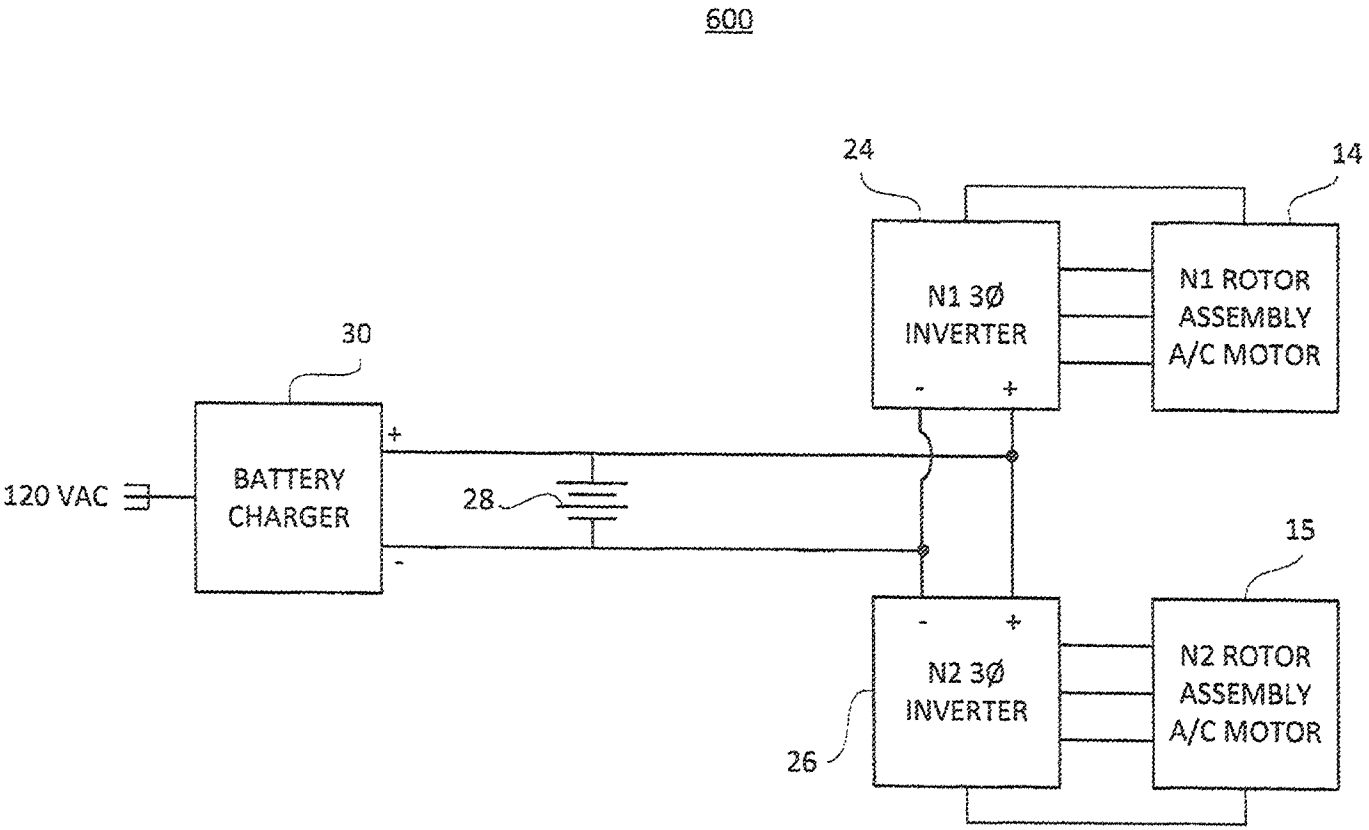
FIG. 6 is a block diagram of another embodiment a drive train for a self-propelled power trowel having rotors configured for reverse rotation according to the invention.

FIG. 6 is a block diagram of an embodiment 600 of a hybrid drive train for a self-propelled power trowel according to the invention. In this embodiment, the electrical power source 10 is achieved by means of a DC battery 28 and battery charger 30, which are used in lieu of the engine, generator, and rectifier described in the previous embodiment. Battery charger 30 is configured to convert AC power, e.g. from a standard 120 or 240 VAC source, into an appropriate DC voltage for charging the battery 30. Battery 30 may be any type known in the art and suitable for this purpose, such as a lithium-ion battery pack or other type used for powering electric vehicles. The power trowel is configured so that the battery charger 30 may be plugged into an electrical outlet for charging while the power trowel is not in service, and disconnected from power when the battery has sufficient charge to drive the trowel. Inverters 24, 26 and AC motors 14, 15 operate as described in the previous embodiment.

Figure 7:
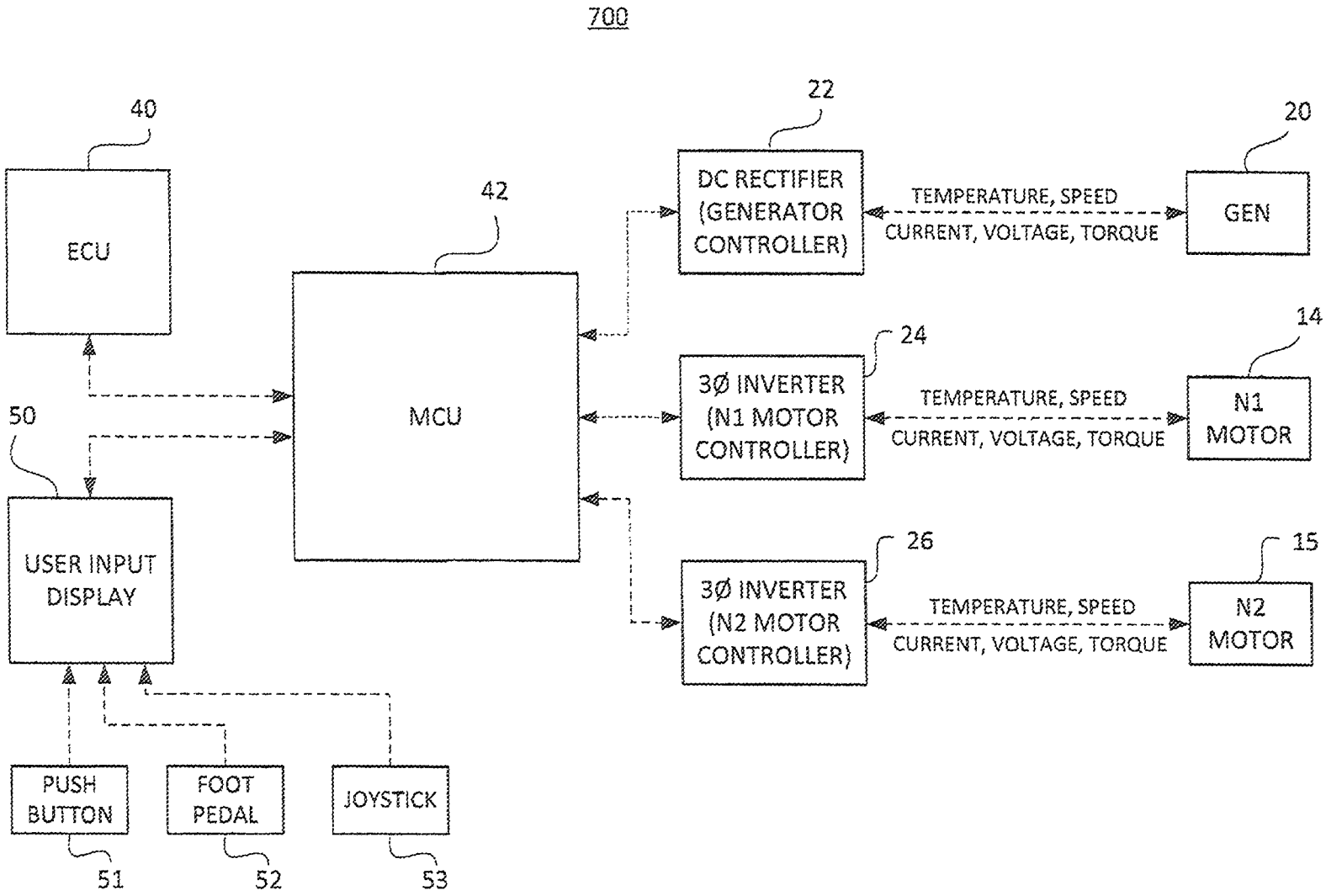
FIG. 7 is a block diagram of one embodiment of a control scheme for a self-propelled power trowel having rotors configured for reverse rotation according to the invention.

FIG. 7 is a block diagram of a control scheme 700 for a hybrid drive train for a self-propelled power trowel according to the invention. Central to control scheme 700 is a Machine Control Unit, or MCU 42. The MCU 42 is a programmable controller having a processor coupled to memory that stores various control algorithms for operating the components of the drive train. In particular, the MCU 42 is configured for adjusting the electrical input to the motors 14, 15, via the rectifiers 24, 26 using feedback control and operator input, to allow for safe and effective operation of the power trowel. In one embodiment, MCU 42 comprises a Parker Hannifin model IQAN-MC4 master controller. The MCU 42 can be mounted directly to the rigid frame of the power trowel and connected by control cabling to the various instruments and components of the power trowel. The control cabling is indicated in the figure by dashed lines. The arrows indicate the direction of transmission of communication and control signals.

MCU 42 is configured for two-way communication with an Engine Control Unit (ECU) 40, the rectifier 22, the inverter 24, the inverter 26, and the User Input Display 50. Rectifier 22 functions as a controller for generator 20. Inverters 24 and 26 function, respectively, as controllers for motors 14 and 15. These inverter and rectifier modules may be proprietary controllers provided by the OEMs of the engine, generator, and motor. The rectifier 22 and inverters 24 and 26 may configured for receiving control signals representing temperature, speed, current, voltage, and/or torque detected for a corresponding motor or generator, and feeding these signals back to MCU 42. Control signals representing a desired current, voltage, speed, or torque (e.g., an output of an MCU 42 control algorithm) may be transmitted from MCU 42 to rectifier 22 or to an inverters 24, 26 for output to the motor or generator 14, 15, or 20. For example, scheme 700 allows for operation of the motors 14, 15 within a safe temperature range. MCU 42, receiving a rising temperature signal from motor 14, can, through execution of an appropriate control algorithm, cool the motor by commanding motor controller 24 to reduce their speed thereby lowering the current in the windings. Many other control algorithms are made possible by scheme 700. For example, the rotor assemblies can be operated at constant torque, or at constant speed, by varying the speed of generator 20, and the duty cycle of the AC signal output by the motor controllers 24, 26, etc.

Manual control signals may be generated by means of the User Input Display 50. The User Input Display 50 provides a human interface to the MCU 42, and allows a human operator to program the MCU 42 for automatic operation, to effect manual control, and to access system information via graphical user interface. The User Input Display 50 includes a microprocessor, memory, an operating system, and software configured with human interfacing and non-human interfacing communication protocols. In one embodiment, the User Input Display 50 comprises a Parker Hannifin model IQAN-MD3 display unit. The User Input Display 50 may also communicate with and translate manual control signals from pushbutton 51, foot pedal 52, joystick 53, or other digital or analog inputs that allow a human operator to operate the power trowel, and may also provide the operator with a means for programming the manual controls for customized operation. In another embodiment, some of these manual controls may connect directly to the MCU 42.

Reverse Rotation

Figure 8:
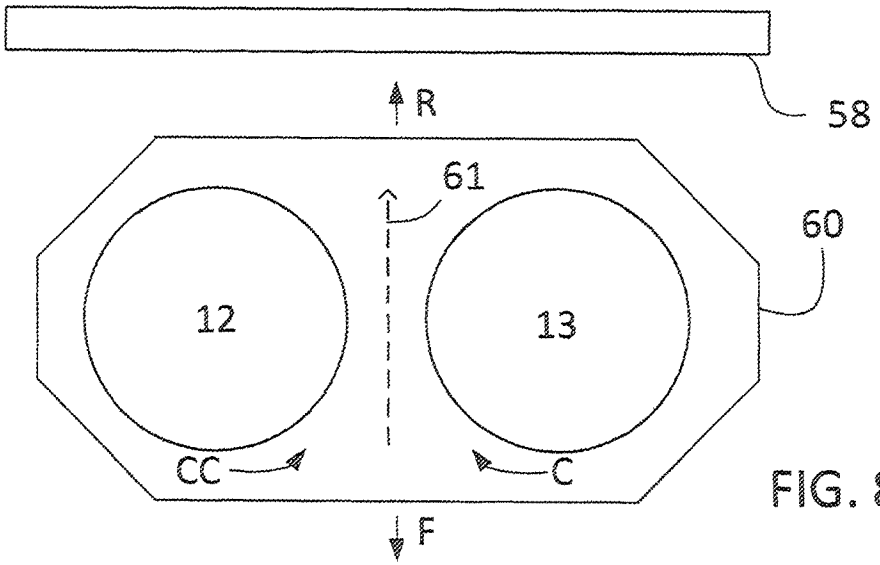
FIG. 8 is a top view of a simplified model of a self-propelled power trowel having rotors configured for reverse rotation according to one embodiment of the invention, showing movement of the trowel in a reverse direction near an edge of a concrete pour.

Self-propelled riding trowels, such as those herein described, operate with the rotors rotating in opposite directions. That is, from the perspective of an operator mounted atop the trowel 100, when the operator is facing forward (looking out of the page from FIG. 1) the rotor 13 rotates clockwise and the rotor 12 rotates counter-clockwise. This situation is also depicted in FIG. 8, which shows a top view of a simplified model of rotors 12 and 13 mounted to a rigid frame 60 for a trowel according to the invention. In operation, this counter-rotational movement tends to draw small bits of concrete and other debris in between the rotor assemblies and force the debris toward the rear of the trowel in the direction 61. When finishing concrete near the edges of the pour, that is, at the form edge 58, skilled operators will drive the trowel in reverse and back up toward the form edge 58. This technique advantageously forces the debris to the form edge 58, where it can be more easily collected for eventual disposal. The difficulty with this technique is that it requires the operator to turn his head and look over his shoulder to guide the trowel while operating the trowel in reverse. In this position, the operator's field of vision is limited and less than ideal, not to mention that it causes considerable discomfort in the head and neck region of the operator. The problem is especially challenging for operators who have a neck injury or some other condition that limits their ability to rotate their neck.

Figure 9:
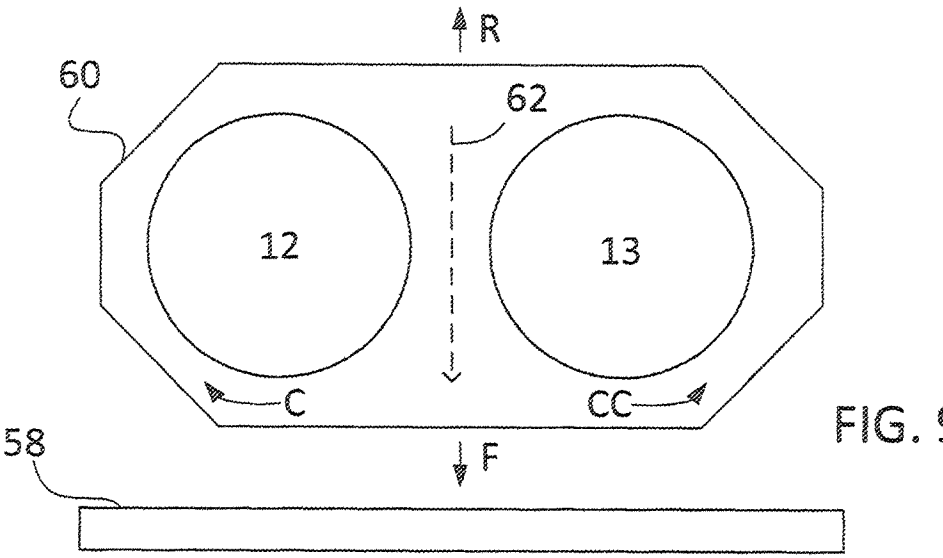
FIG. 9 is another top view of a simplified model of a self-propelled power trowel having rotors configured for reverse rotation according to one embodiment of the invention, showing movement of the trowel in a forward direction near an edge of a concrete pour.

The present invention provides two solutions to the aforesaid problem of finishing a pour close to the form edge, in which solutions the operator is not required to turn his head. In the first solution, a self-propelled riding trowel according to the invention is configured with special controls that allow an operator to reverse the rotational direction of the rotors 12 and 13. This situation is depicted in FIG. 9. When the rotor rotations are so reversed, the debris is forced through the trowel in the direction 62, which is opposite direction 61, and the operator can approach the form edge 58 while driving the trowel in a forward direction. Thus, the operator can advantageously look straight ahead with a full field of view and still force debris to the form edge 58.

Reversing the rotational direction of the rotors, however, will cause the trowel to respond oppositely to the steering controls. That is, a forward command (e.g. from a joystick control) will cause the trowel to move in the reverse direction, and vice versa. To alleviate this problem, self-propelled trowels having reversible rotors according to the present invention may also be configured with a means for inverting the steering controls in response to reversal of rotor rotation. With this feature, the operation of the steering controls required to cause a desired directional movement of the trowel remains the same, regardless of the direction of rotation of the rotatable rotor assemblies.

For example, on a hydraulically driven trowel, one method for reversing the rotation of the trowel rotors is illustrated as follows: First and second electrical control inputs may be coupled to the hydraulic pump and configured so that energization of the first control input actuates a first control valve to cause hydraulic fluid to flow through one side of the pump, and so that energization of the second control input actuates a second control valve to cause hydraulic fluid to flow through an opposite side of the pump. The direction of flow of the hydraulic fluid determines the direction of rotation of a swashplate which, in turn, determines the direction of rotation of the trowel rotors. The control inputs may be energized, for example by operator action such as a pushbutton control. Action of the pushbutton control also causes a steering inversion signal to effect inversion of the steering controls. In one example, the steering inversion may be effected by the steering inversion signal causing a set of spool valves to shift from one position to another, thereby changing the direction of fluid flow in hydraulic lines that supply the steering actuator that is coupled to the rotor assembly.

In another example, on an electrically driven trowel, the rotational direction (positive or negative) of the rotors may be determined by commanding the rotor drive controls for positive (or negative) torque and for positive (or negative) speed. The command signal may be initiated by actuation of an operator pushbutton or other control configured to cause the desired drive signal. Steering inversion logic may invert the steering controls by simply outputting command signals to different pins, in response to the pushbutton actuation.

Figure 10:
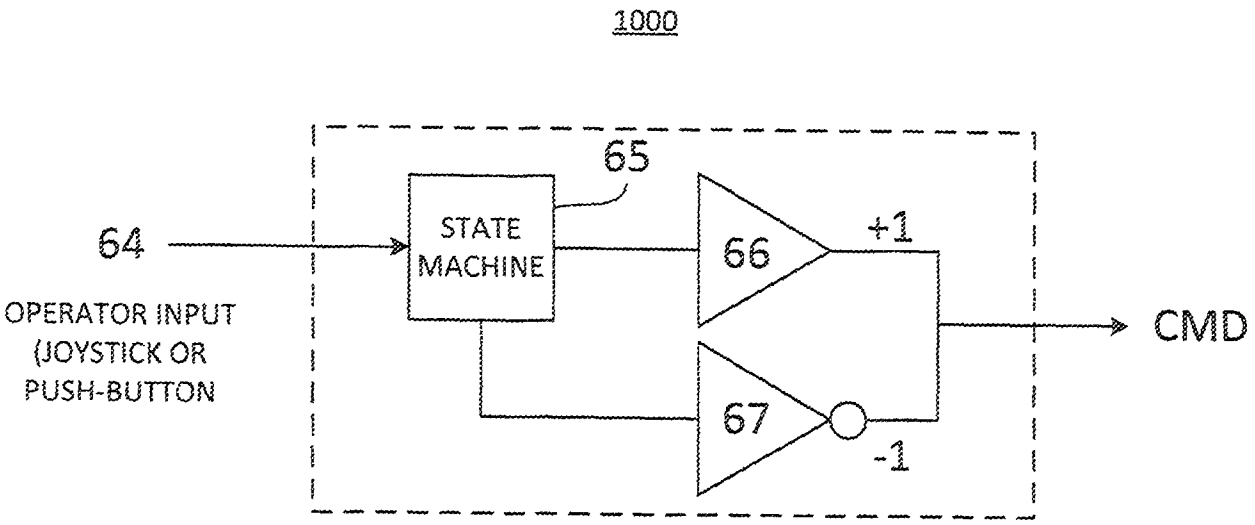
FIG. 10 is a block diagram showing one example of inversion logic that may be implemented in a control scheme for a self-propelled power trowel having rotors configured for reverse rotation according to the invention.

FIG. 10 shows one example of inversion logic that may be implemented in a control scheme 1000 for either a hydraulically driven or electrically driven trowel according to the invention. Input 64 represents a control signal initiated by an operator pressing a pushbutton, e.g. on a joystick, mounted to a control panel, or displayed on a touch-screen user input display. The state machine 65 determines which of logic devices 66 or 67 receives the signal. For example, each time the button 64 is pressed, state machine 65 switches its output from one logic device to the other. For example, when state machine 65 activates AND gate 66, a logical one, or high voltage signal, is output as the CMD signal. On the other hand, when state machine 65 activates NAND gate 67, a logical negative one, or low voltage signal, is output as the CMD signal. In the case of the hydraulically driven trowel, a +1 CMD signal would open a control valve, and a −1 CMD signal would close the same control valve. The control valve would, in turn, control hydraulic fluid flow to another valve that actuates the hydraulic actuator. In the case of the electrically driven trowel, the same logic circuit 1000 could be used to directly command a valve that feeds the hydraulic actuators.

In the second solution, the invention provides a self-propelled riding trowel configured with a back-up camera that outputs a video signal in real time to the user input display 50. This allows the operator to approach the form edge in reverse, without reversing the rotational direction of the rotors, while looking forward at the visual display.

Another control feature for a self-propelled trowel according to the invention allows an operator to adjust the resolution of the throttle or foot pedal that controls rotor speed. In other words, the invention allows the operator to re-scale the span of speeds that are controlled by the foot pedal. For example, maximum speed can be manually set by the operator by selecting a desired maximum speed using controls available on the user display input. When the desired speed maximum speed is selected, programming logic sets the desired maximum speed to coincide with maximum depression of the foot pedal. In this condition, the span of speeds controllable by the foot pedal ranges from zero (or from some other operator-selected minimum speed) to the desired maximum speed. Thus, if 130 RPM is selected as the maximum speed, the rotors are programmed to achieve 130 RPM when the foot pedal is fully depressed, approximately 65 RPM when the foot pedal is halfway depressed, etc. Higher resolution, or finer control, over rotor speed can thereby be made available to an operator by setting lower maximum speeds.

Another control feature for a self-propelled trowel according to the invention allows an operator to set a fixed rotor speed by throttling the foot pedal 52 to a desired speed, then pressing a cruise control switch 88 or touch-screen button on the user input display. Pressing the cruise control switch 88 invokes control logic that maintains power to the rotors at a fixed level to achieve the desired speed regardless of foot pedal position. In one embodiment, pressing the cruise control switch 88 a second time cancels the cruise control feature and returns the scheme to normal control mode.

Figure 11:
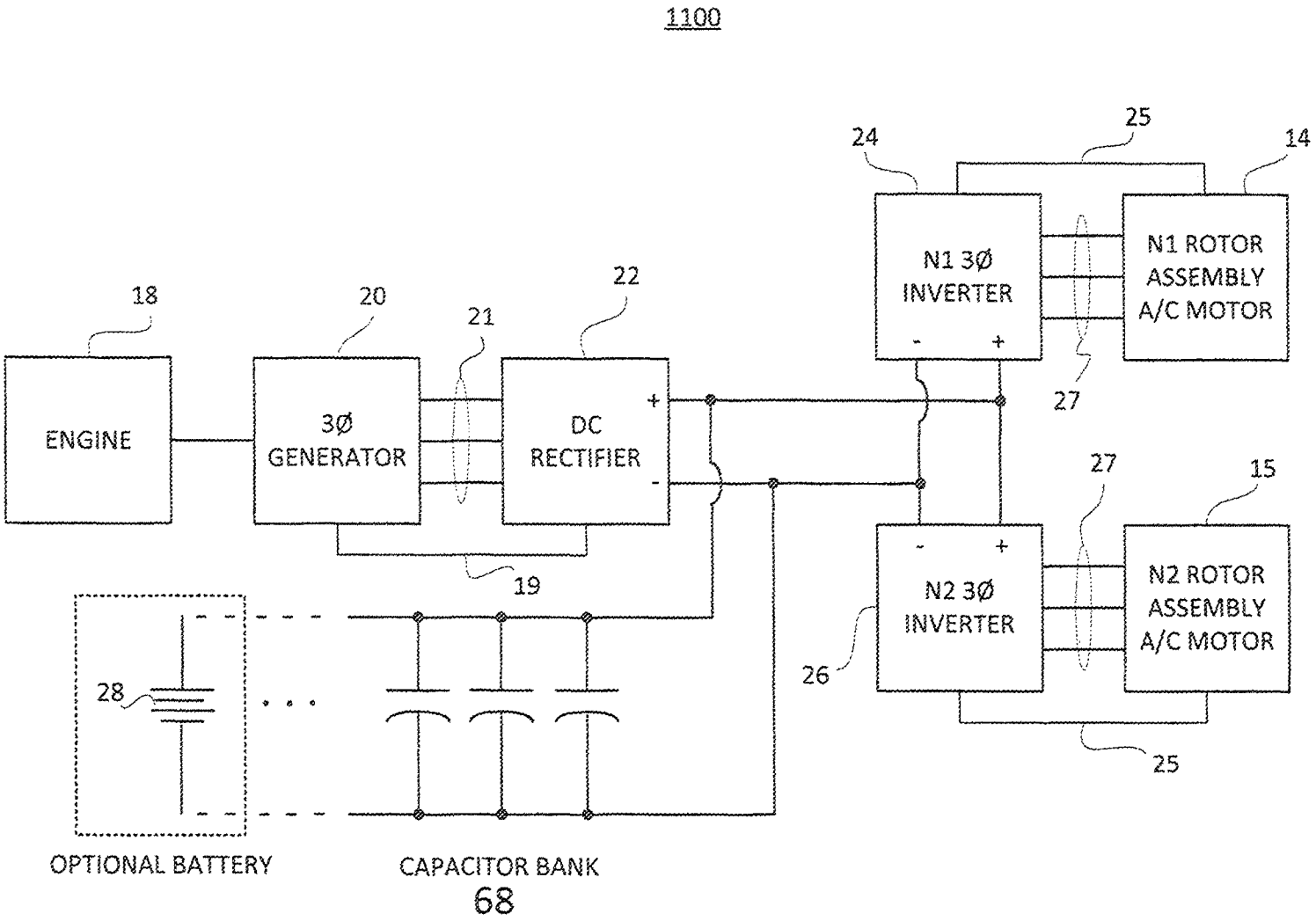
FIG. 11 is a block diagram of another embodiment of a drive train for a self-propelled power trowel according to the invention, in which the power trowel is equipped with a means for storing energy and a means for discharging the stored energy to assist in driving a required load.

FIG. 11 illustrates another embodiment of the invention, in which a self-propelled riding trowel is equipped with a means for storing energy and a means for discharging the stored energy to assist in driving a required load. Drive train 1100 is a hybrid drive train similar in form and operation to the drive train described above with reference to FIG. 5. Drive train 1100, however, includes a capacitor bank 68 couples in parallel with the output of DC rectifier 22. A battery bank 28 may be optionally installed in parallel with the capacitor bank 68. Capacitor bank 68 may consist of one or more capacitors, such as high power ceramic or film capacitors, configured to achieve a desired capacitance. During changing load conditions, the capacitor bank 68 can smooth a transient voltage condition appearing across the output of DC rectifier 22, for example, by discharging to mitigate the effects of back EMF.

In a hydraulically driven embodiment of a self-propelled trowel according to the invention, one or more accumulators may be installed in the hydraulic fluid circuit to achieve the analogous effect of discharging stored energy into the drive circuit in the form of pressurized hydraulic fluid to assist the drive train in driving a required load during transient loading conditions.

FIGS. 12 through 22 show additional features that may be installed on a self-propelled trowel according to the present invention.

Figure 12:
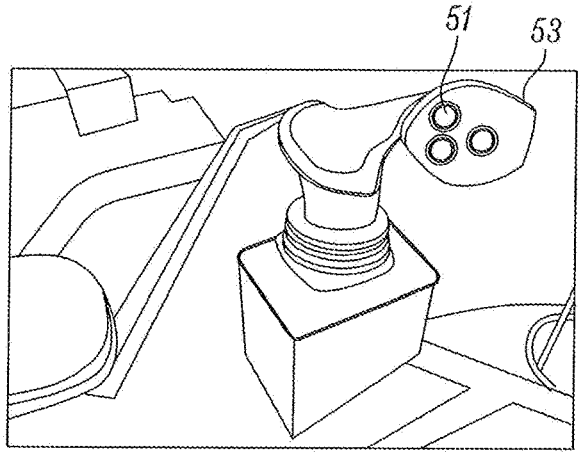
FIG. 12 is a perspective view of a joystick control equipped with multiple pushbuttons, for use on a self-propelled power trowel according to the invention.

FIG. 12 illustrates an embodiment of a joystick control 53 equipped with three pushbutton controls 51. In this example, each of the three pushbuttons corresponds to a unique control feature that allows an operator to either (1) Increase Pitch, (2) Decrease Pitch, or (3) place the trowel in Panning Mode. The joystick 53 allows the operator to steer the trowel by moving the joystick in a direction representing a desired direction of movement.

Figure 13:
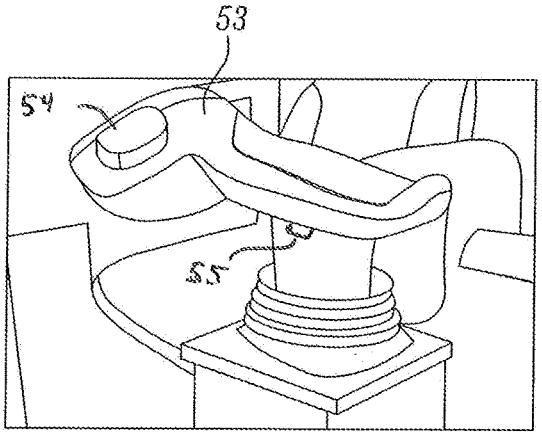
FIG. 13 is a perspective view of another joystick control equipped with multiple pushbuttons, for use on a self-propelled power trowel according to the invention.

FIG. 13 shows another view of a manual control in the form of a joystick 53. The joystick 53 is equipped with a single control button 54 that can affect three different control features, depending whether control button 54 is depressed forward, to the center, or to the rear. When control button 54 is depressed forward, it effects a right pitch of the rotor blades. When control button 54 is depressed in the center, it effects a twin pitch of the rotor blades. And when control button 54 is depressed to the rear, it effects a left pitch of the rotor blades. Joystick 53 may also be equipped with a switch 55 for controlling an auxiliary function, such as spraying a retardant or other chemical from a nozzle located elsewhere on the trowel frame 60.

Figure 14:
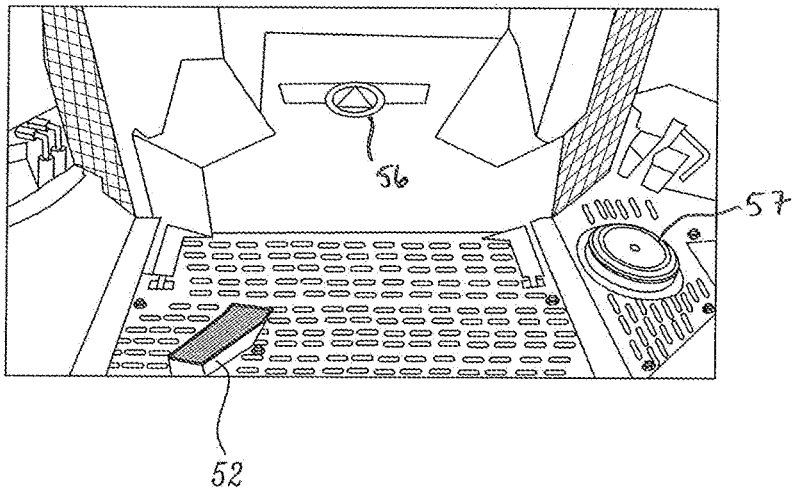
FIG. 14 is a frontal perspective view of the cab area of another embodiment of the invention.

FIG. 14 shows various other controls and features that can be mounted on a trowel frame 60 of the present invention. Theses controls and accessories may include one or more of a cup holder and accessory bin 56, a retardant tank 57, and a foot pedal 52 that is used as a throttle to control the rotational speed of the rotor blades.

Figure 15:
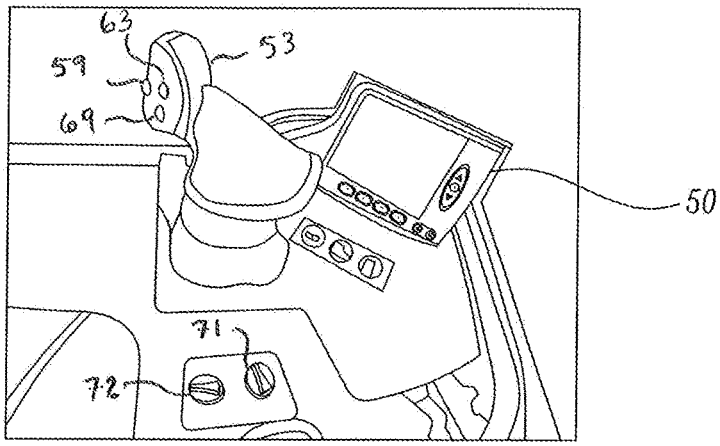
FIG. 15 shows a perspective view of another joystick control for the present invention, which is configured with a cruise control switch when can be activated when the rotor blades are rotating at a desired speed.

FIG. 15 shows a joystick 53 configured with a multi-function switch 59. The multi-function switch 59 can function as a Cruise Control Switch which can be activated when the rotor blades are rotating at a desired speed. The same switch 59 can function as an Engine Speed Adjustment that allows an operator to customize the throttle speed span by setting a maximum speed when the blades are not rotating. The desired speed may be achieved by using one or both of the Increase Max Blade Speed button 63 and Decrease Max Blade Speed button 69 to adjust the speed setting up and down until the desired speed is achieved, at which point the Engine Speed Adjustment button can be pressed. User input display 50 is also shown, along with a Key Switch 71 that is used when starting the trowel, and an optional Fuel Selection Switch 72 that allows an operator to select propane or gas as the fuel source for the on-board engine.

Figure 16:
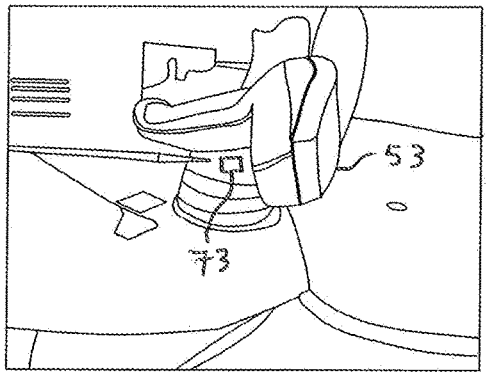
FIG. 16 shows a perspective view of another joystick control for use with the present invention.

FIG. 16 shows the Right Retardant Spray Switch 73 mounted beneath the handle of a joystick 53. When the Right Retardant Spray Switch is depressed, it causes retardant to flow through a spray nozzle mounted elsewhere on the trowel frame 60.

Figure 17:
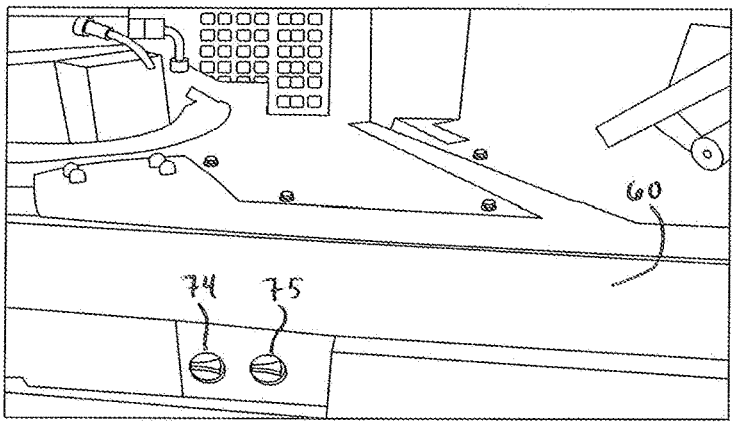
FIG. 17 is a magnified side perspective view of an embodiment of the present invention, showing additional locations for manual controls.
Figure 18:
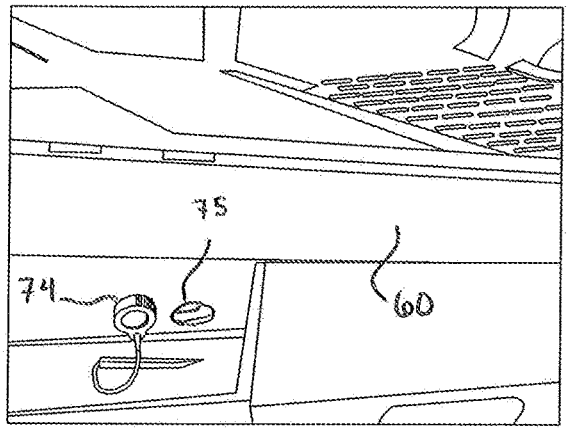
FIG. 18 is another magnified side perspective view of an embodiment of the present invention, showing additional locations for manual controls.

FIGS. 17 and 18 show electrical connectors mounted to the right and left sides, respectively, of the rigid frame 60. A Diagnostic Connector 74 may be provided to allow a diagnostic program to assess the operability of the trowel systems. A Drive Bypass Switch 75, also mounted to the rigid frame 60, may be provided on both the left and right sides of the trowel, as shown.

Figure 19:
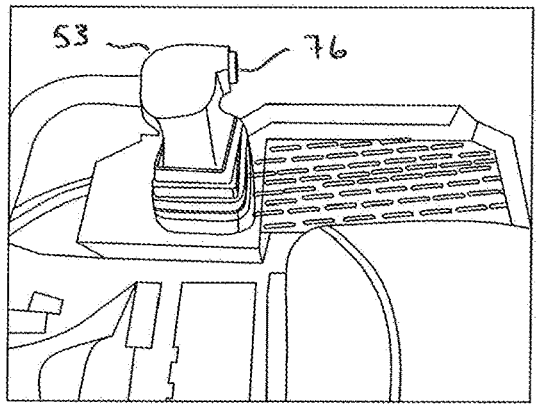
FIG. 19 is a perspective view looking downward at a left-hand joystick, illustrating the location of a retardant spray switch from the operator's perspective.

FIG. 19 shows a perspective view looking downward at a joystick 53, illustrating the location of a Left Retardant Spray Switch 76 from the operator's perspective.

Figure 20:
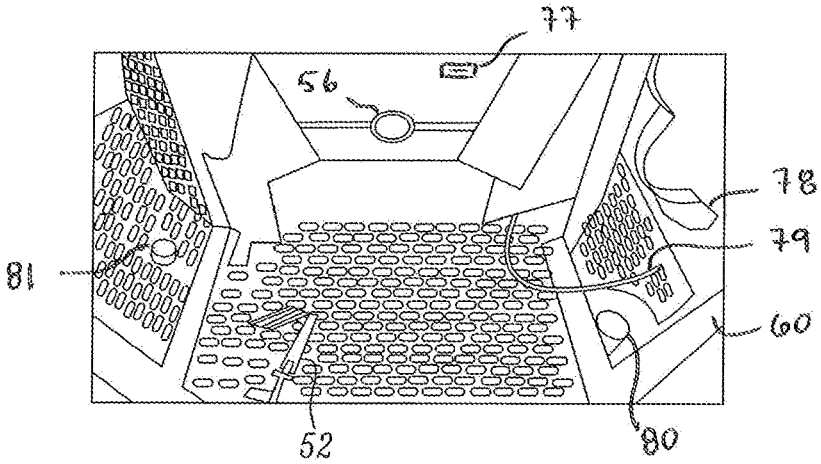
FIG. 20 is a frontal perspective view of another embodiment of the present invention, showing additional features of a self-propelled power trowel having rotors configured for reverse rotation.

FIG. 20 shows additional features of a trowel according to the invention. Shown in this figure are mounting locations for a USB Charger 77, Cup Holder and Accessory Bin 56, Propane Tank Mount 78 and Propane Hose 79, Fuel Tank Fill Port 80, Retardant Tank Fill Port 81, and foot pedal 52 (i.e., Blade Speed Control).

Figure 21:
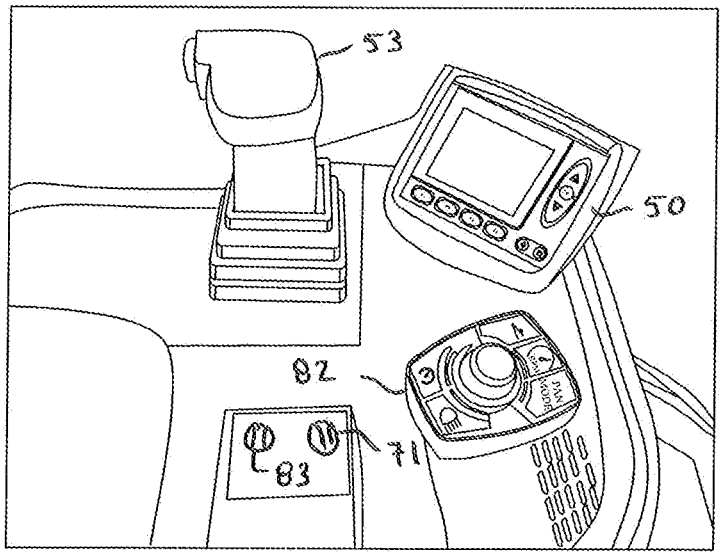
FIG. 21 is a perspective view of an embodiment of the present invention looking downward at a right joystick and user input display, from the perspective of an operator.

FIG. 21 shows a perspective view looking downward at a joystick 53 and user input display 50, from the perspective of an operator. Also shown are mounting locations for a Multifunction Controller 82, the Key Switch 71, and the Fuel Selection Switch 83.

Figure 22:
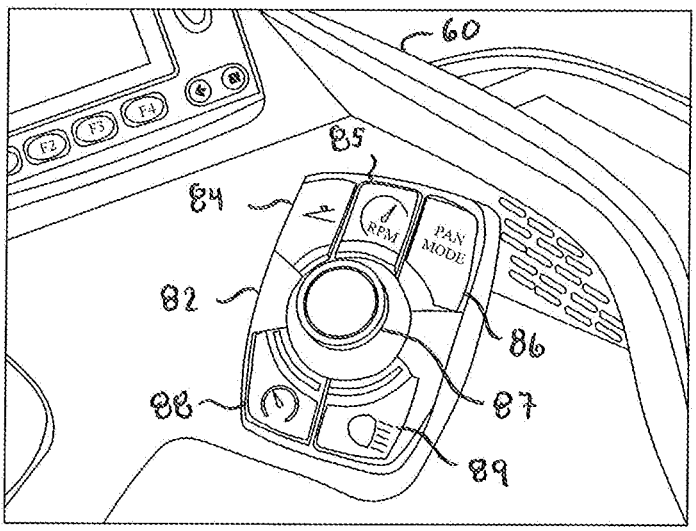
FIG. 22 shows a magnified view of a multifunction controller for use on a self-propelled power trowel according to the present invention.

FIG. 22 shows a magnified view of the Multifunction Controller 82. The Multifunction Controller provides various additional parametric controls within reach of the operator, including a Pitch System Selection switch 84, a Blade Speed Adjustment switch 85, a Panning Mode switch 86 (which must be held for about 3 seconds to activate its feature), and a Multifunction Input wheel 87, which may be rotated to increment a selected parameter, and pressed to effect selection at a desired level. The Multifunction Controller 82 also provides a Cruise Control switch 88 and a Work Lights switch 89.

Figure 23:
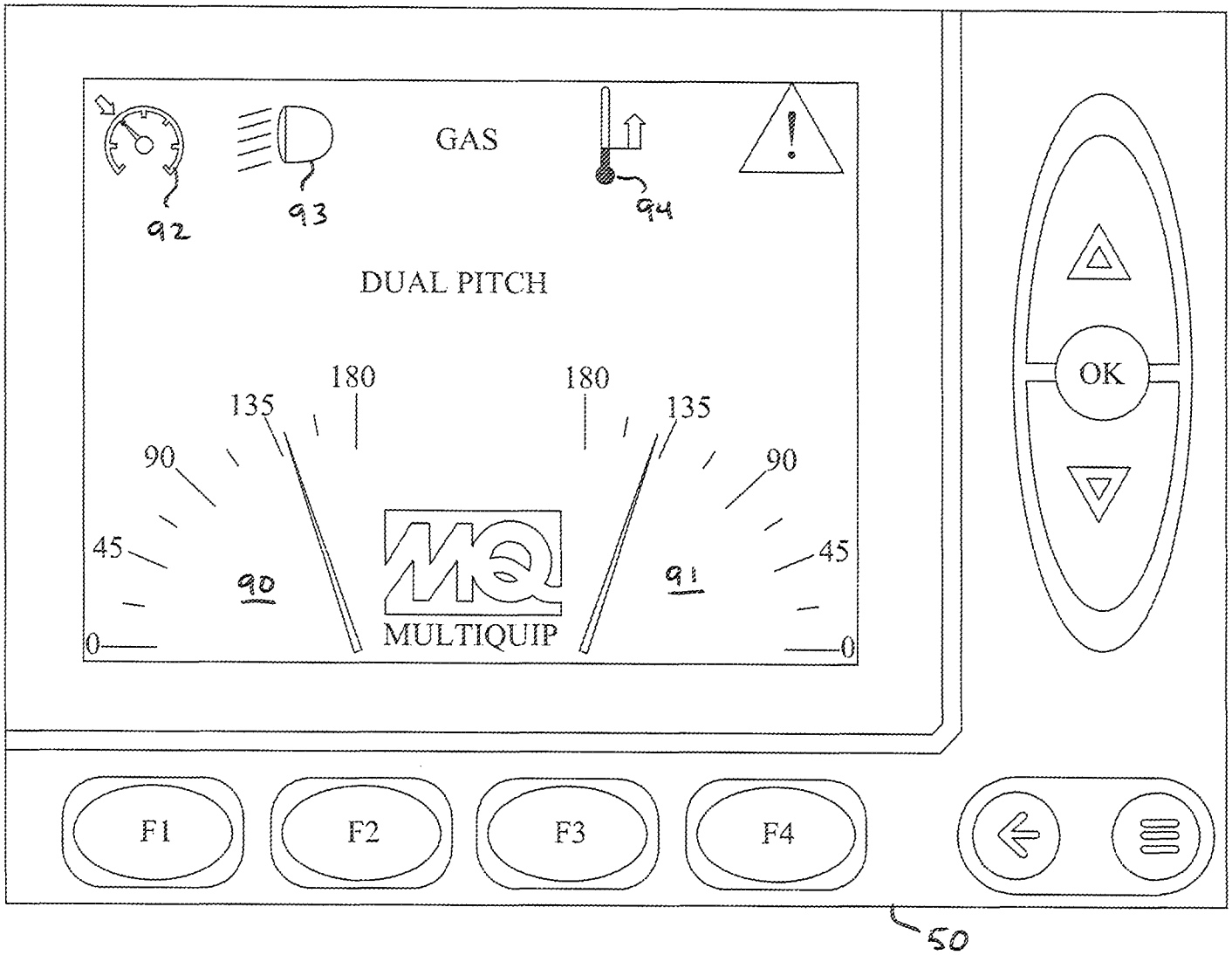
FIG. 23 shows one example of operating information presented on a user input display according to an embodiment of the present invention.
Figure 24:
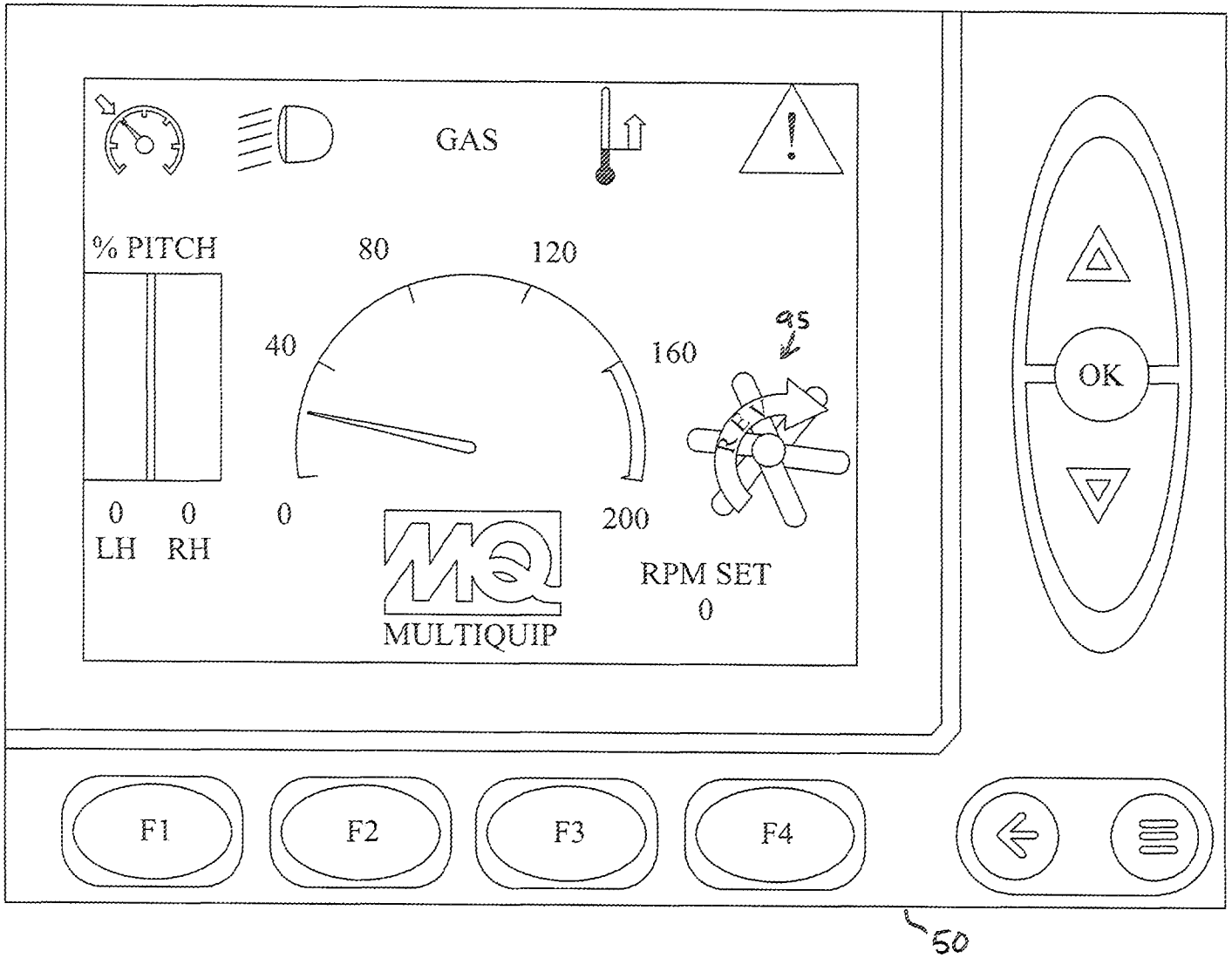
FIG. 24 shows another example of operating information presented on a user input display according to an embodiment of the present invention.
Figure 25:
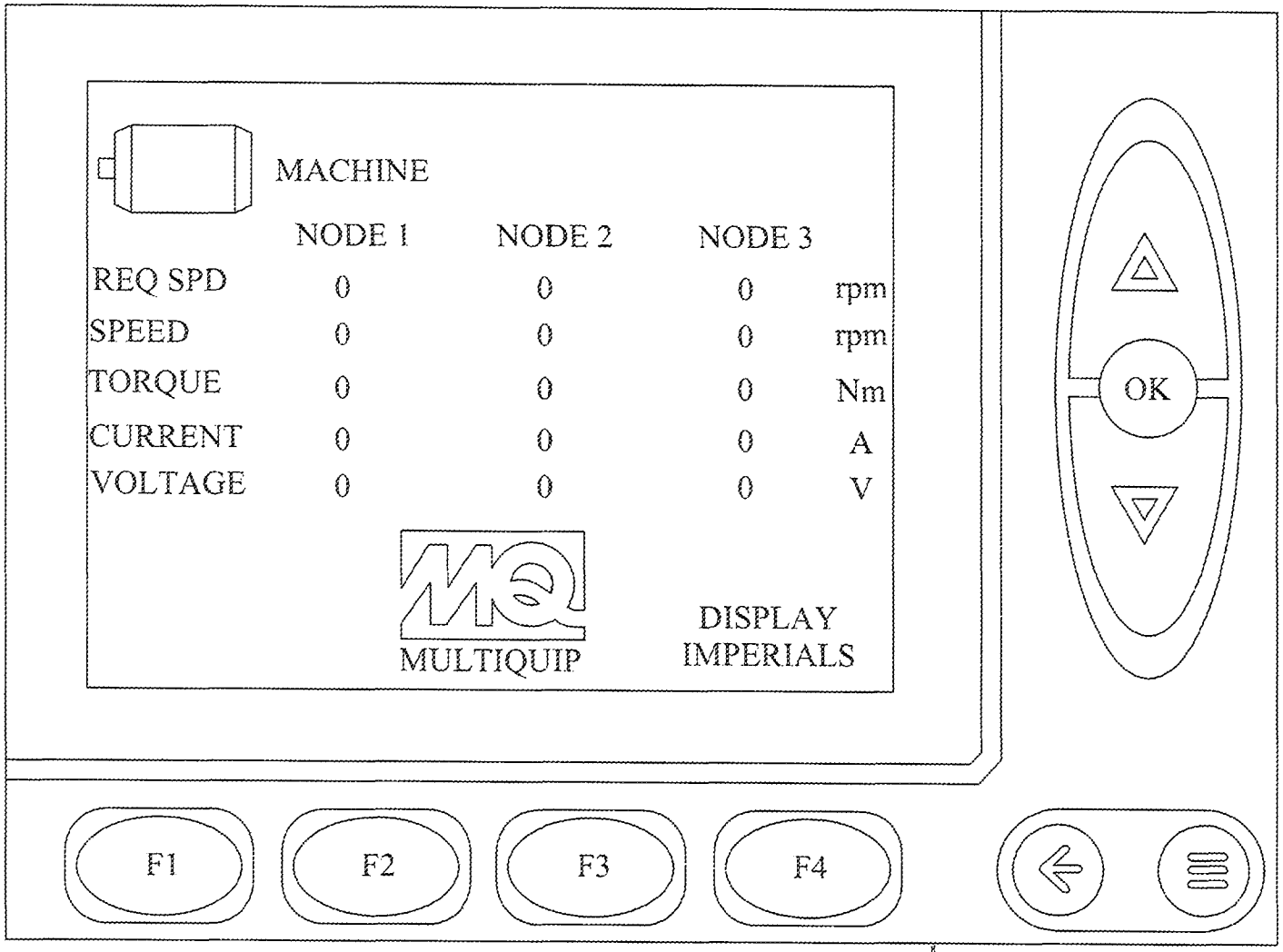
FIG. 25 shows another example of operating information presented on a user input display according to an embodiment of the present invention.
Figure 26:
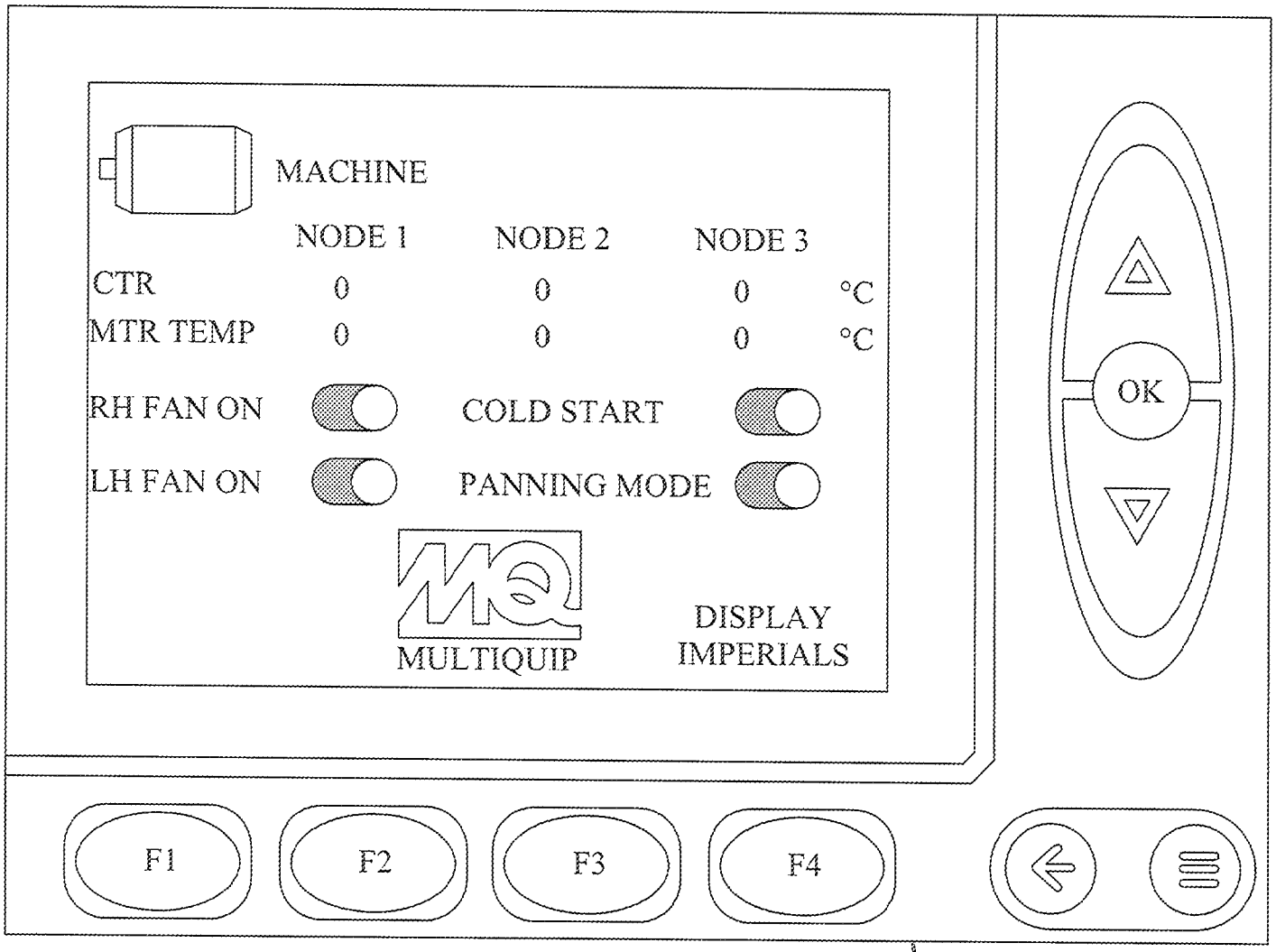
FIG. 26 shows another example of operating information presented on a user input display according to an embodiment of the present invention.
Figure 27:
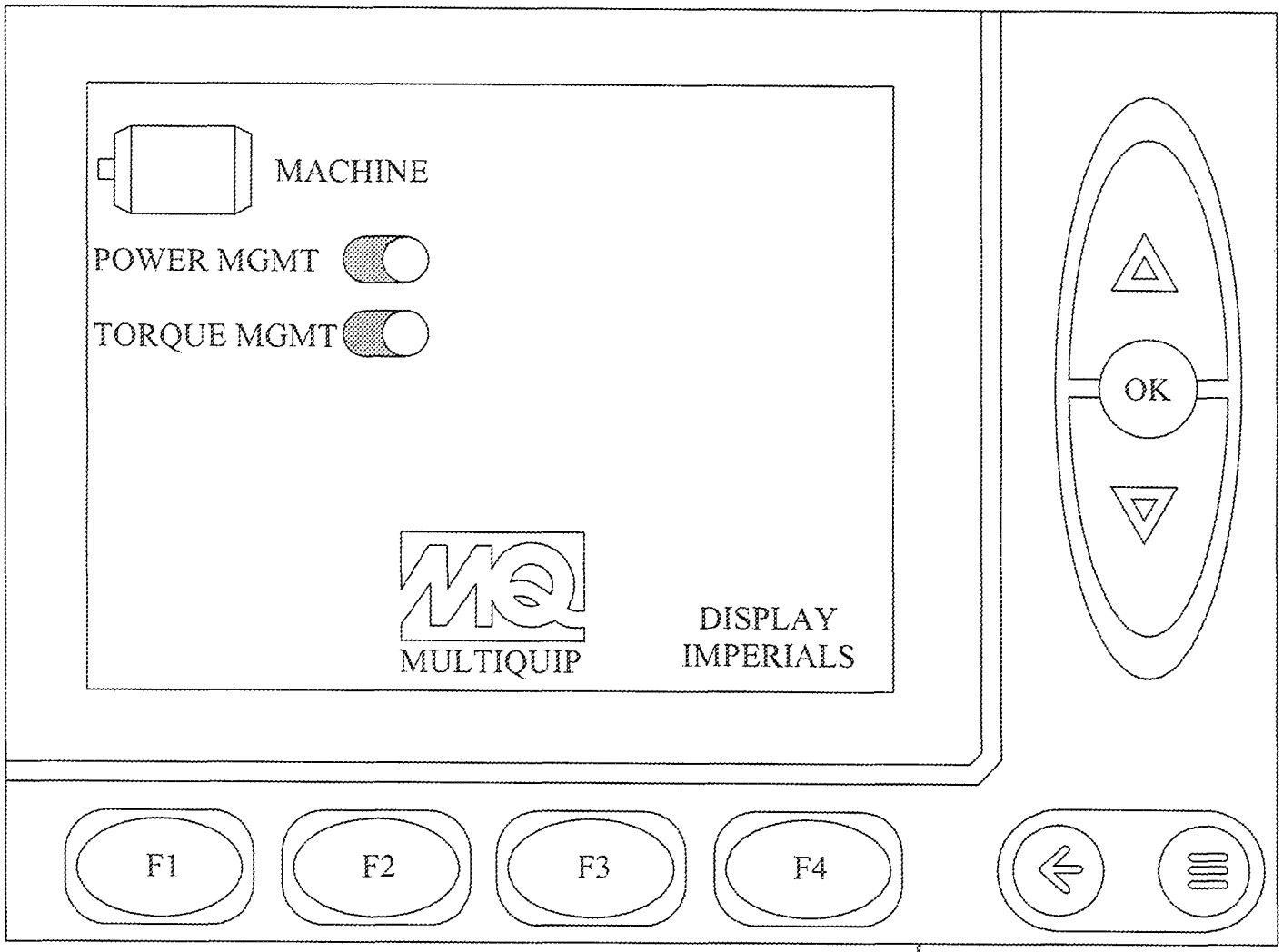
FIG. 27 shows another example of operating information presented on a user input display according to an embodiment of the present invention.
Figure 28:
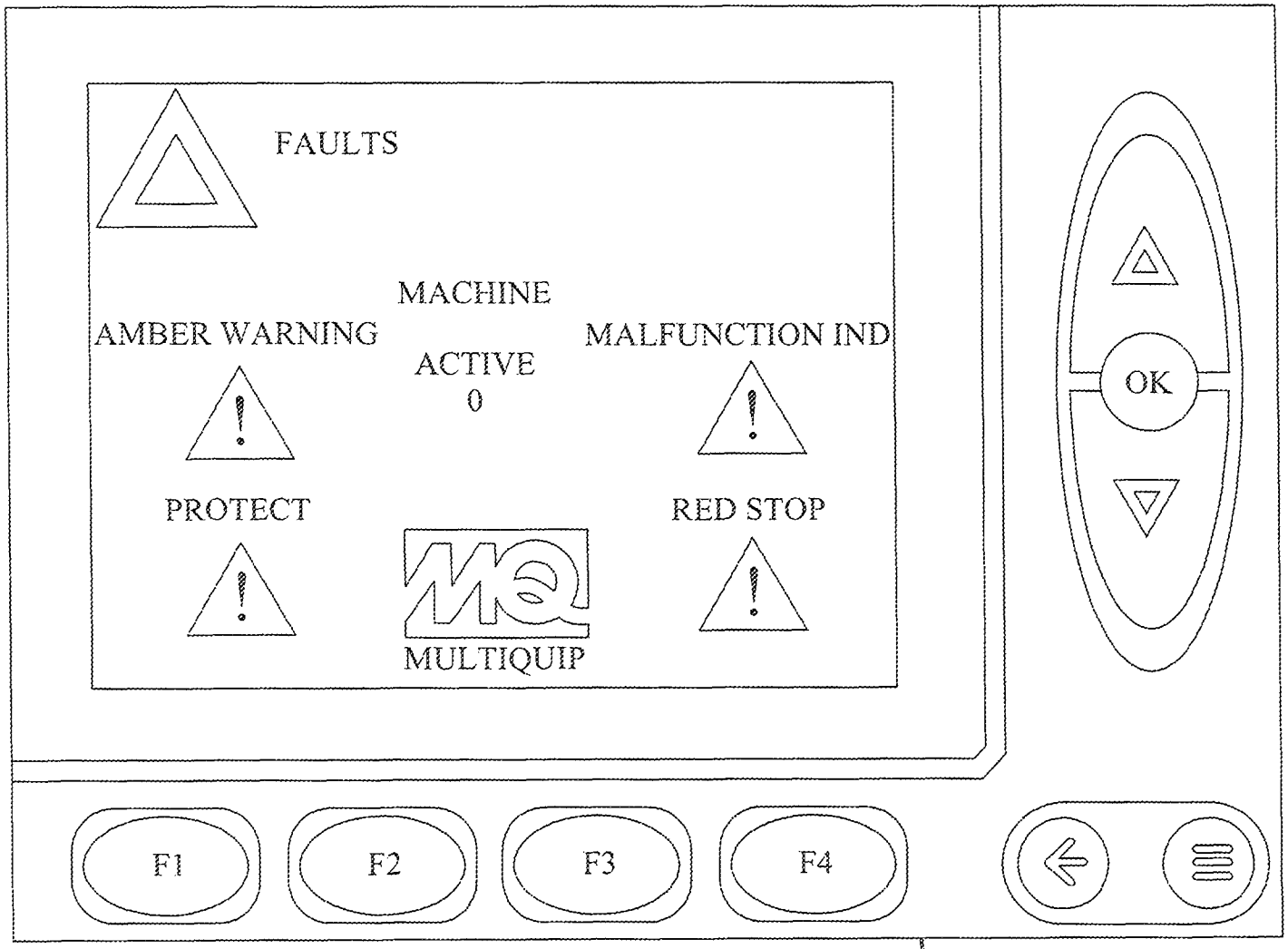
FIG. 28 shows another example of operating information presented on a user input display according to an embodiment of the present invention.
Figure 29:
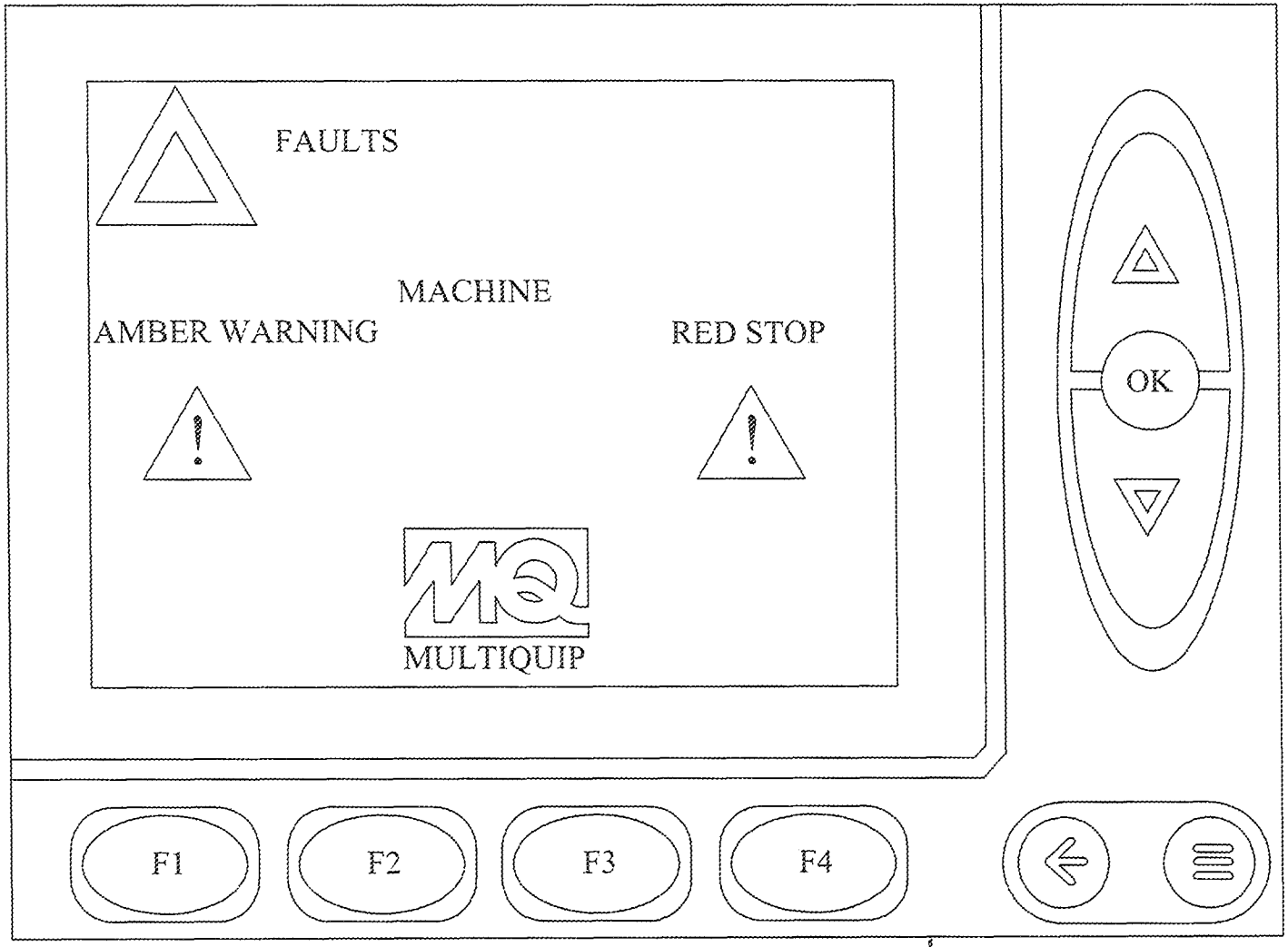
FIG. 29 shows another example of operating information presented on a user input display according to an embodiment of the present invention.
Figure 30:
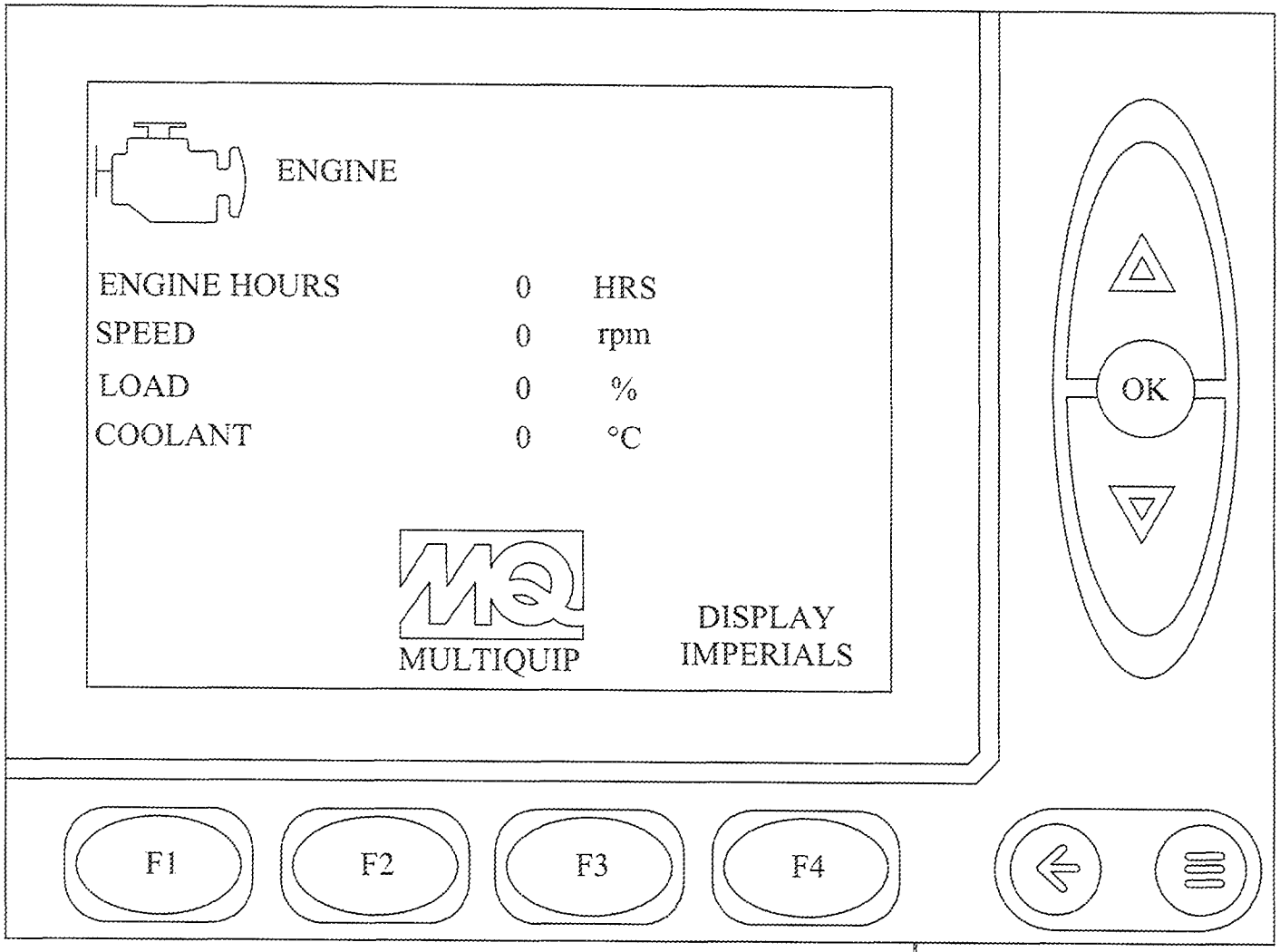
FIG. 30 shows another example of operating information presented on a user input display according to an embodiment of the present invention.
Figure 31:
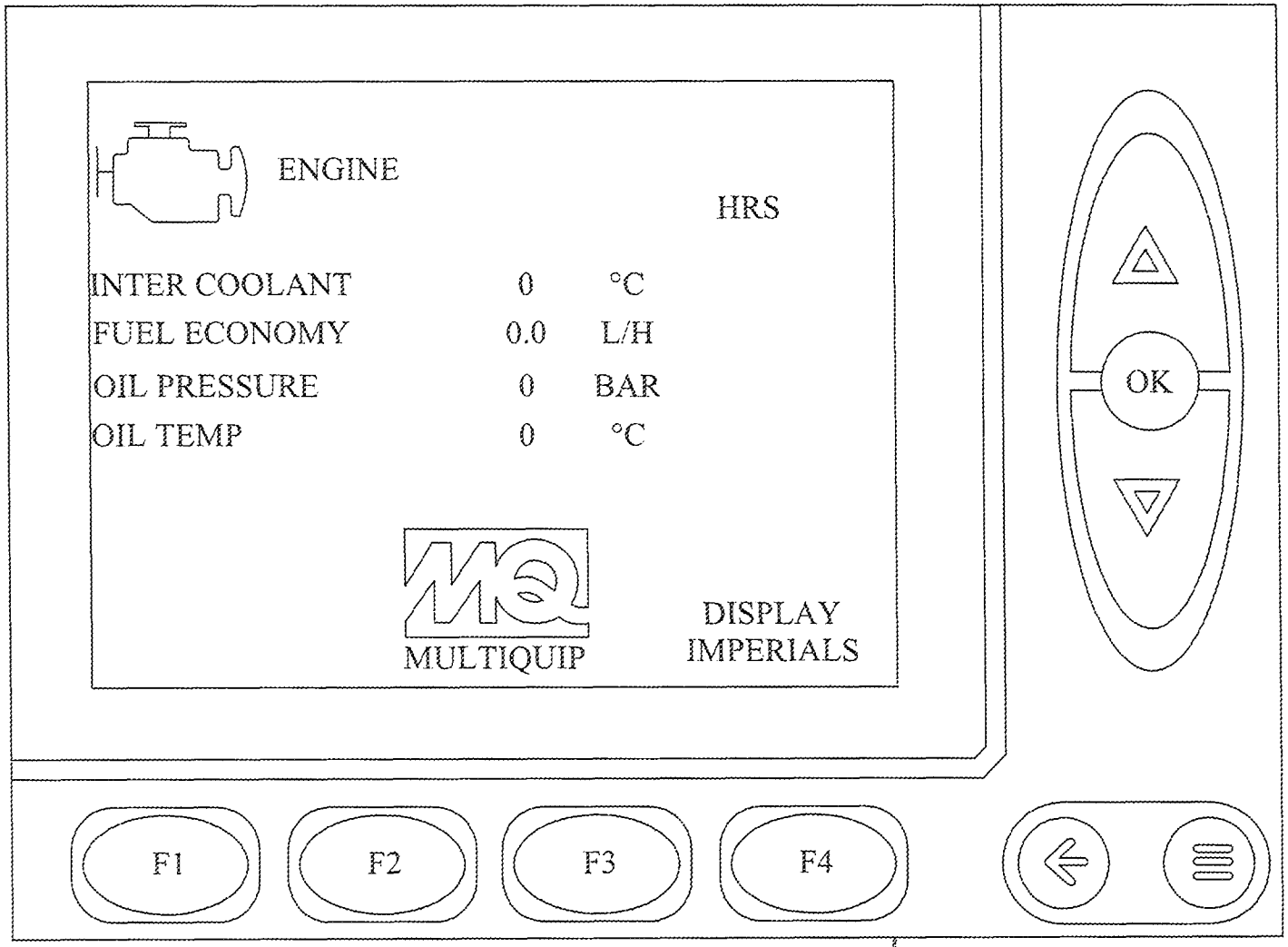
FIG. 31. shows another example of operating information presented on a user input display according to an embodiment of the present invention.
Figure 32:
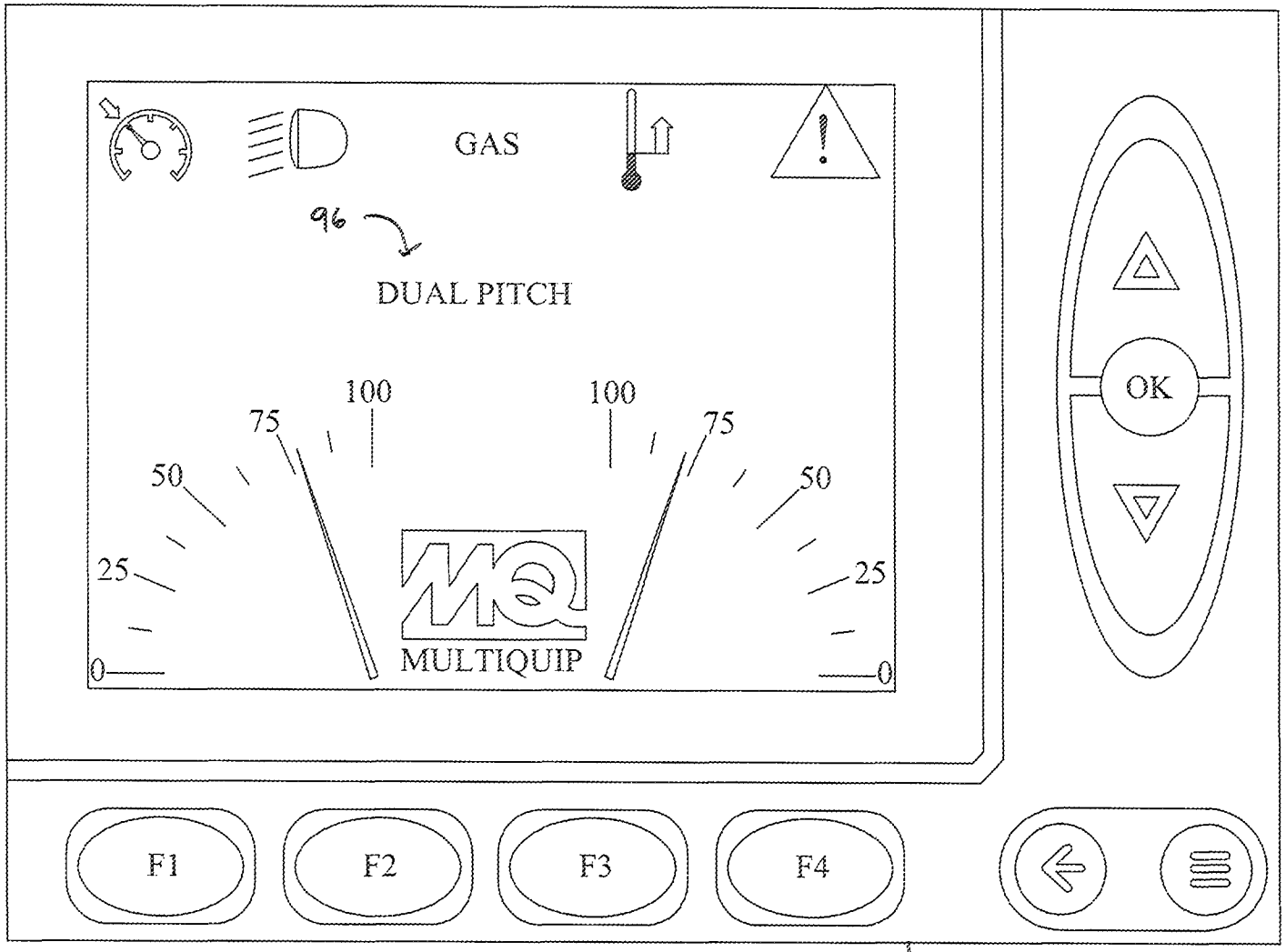
FIG. 32 shows another example of operating information presented on a user input display according to an embodiment of the present invention.

FIGS. 23 through 32 show various examples of display screens that can be visually provided to an operator on the user input display 50. The user input display 50 also provides multiple pushbuttons (F1, F2, F3, F4) that allow the operator to toggle among different display screens, or adjust different parameter levels. The screen of FIG. 23 shows the operator speedometers 90 and 91 for each of the left and right rotors, along with various other symbols that communicate operating conditions of the trowel, including direction of travel 92, headlight status 93, and temperature 94. The screen of FIG. 24 in the lower right screen area shows an icon 95 that indicates to the operator that the trowel has been placed in reverse rotation mode, that is, the rotors are rotating in directions opposite to their normal directions of rotation. The icon 95 may be displayed responsive to the operator changing the mode of operation to reverse rotation mode. The screens of FIGS. 25, 26 and 27 show various Machine operating parameters and conditions. The screens of FIGS. 28 and 29 show various Fault or alarm icons that illuminate when the trowel control system detects a fault in one or more subsystems. The screens of FIGS. 30 and 31 show various conditions of Engine operating parameters. Finally, FIG. 32 shows a Dual Pitch display 96 that may indicate the degree of pitch for each rotor assembly.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A self-propelled power trowel, for finishing a concrete surface, comprising:

a rigid frame means adapted to be disposed over the concrete surface;

a pair of rotor assemblies each having rotor blades for frictionally contacting the concrete surface and supporting the rigid frame means thereabove, wherein the pair of rotor assemblies are configured to move the power trowel in a forward and a reverse direction; and a user input display mounted to the rigid frame and viewable by a local operator while operating the power trowel, the user input display configured to display a video signal received from a rear facing video camera;

wherein the user input display comprises a graphical user interface that provides a human interface to a programmable controller;

wherein the programmable controller further comprises a memory storing at least one customizable parameter for operating the power trowel that is selectable by an operator through the graphical user interface; and wherein the at least one customizable parameter comprises maximum operating temperature of the rotor assemblies.

2. The self-propelled power trowel of claim 1, wherein the user input display displays the video signal from the rear facing video camera in response to the power trowel moving in the reverse direction.

3. The self-propelled power trowel of claim 1, wherein the user input display receives the video signal in real time from the rear facing video camera.

4. The self-propelled power trowel of claim 1, wherein the graphical user interface provides a means for generating manual control signals.

5. The self-propelled power trowel of claim 1, wherein the graphical user interface is configured to allow the local operator to preset the at least one customizable parameter to a desired value.

6. The self-propelled power trowel of claim 1, wherein the user input display includes software configured with a non-human interfacing communication protocol.

7. The self-propelled power trowel of claim 1, wherein the user input display is configured to receive an analog input.

8. The self-propelled power trowel of claim 7, wherein the analog input comprises a signal received from a pushbutton mounted to the rigid frame.

9. The self-propelled power trowel of claim 8, wherein the pushbutton is configured to increase and decrease a pitch of the rotor blades of one or both of the rotor assemblies.

10. The self-propelled power trowel of claim 7, wherein the analog input is received from a foot pedal mounted to the rigid frame.

11. The self-propelled power trowel of claim 10, wherein the foot pedal is configured to control rotational speed of the rotor blades.

12. The self-propelled power trowel of claim 11, further comprising a control button, wherein the control button is configured to lock the rotational speed of the rotor blades at a speed set by actuation of the foot pedal.

13. The self-propelled power trowel of claim 7, wherein the analog input is received from a joystick mounted to the rigid frame.

14. A self-propelled power trowel, for finishing a concrete surface, comprising:

a rigid frame means adapted to be disposed over the concrete surface;

a pair of rotor assemblies each having rotor blades for frictionally contacting the concrete surface and supporting the rigid frame means thereabove, wherein the pair of rotor assemblies are configured to move the power trowel in a forward and a reverse direction; and a user input display mounted to the rigid frame and viewable by a local operator while operating the power trowel, the user input display configured to display a video signal received from a rear facing video camera;

wherein the user input display comprises a graphical user interface that provides a human interface to a programmable controller;

wherein the programmable controller further comprises a memory storing at least one customizable parameter for operating the power trowel that is selectable by an operator through the graphical user interface; and wherein the at least one customizable parameter comprises at least one of (i) speed of the rotor assemblies and (ii) torque of the rotor assemblies.

15. A self-propelled power trowel, for finishing a concrete surface, comprising:

a rigid frame means adapted to be disposed over the concrete surface;

a pair of rotor assemblies each having rotor blades for frictionally contacting the concrete surface and supporting the rigid frame means thereabove, wherein the pair of rotor assemblies are configured to move the power trowel in a forward and a reverse direction; and a user input display mounted to the rigid frame and viewable by a local operator while operating the power trowel, the user input display configured to display a video signal received from a rear facing video camera;

wherein the user input display comprises a graphical user interface that provides a human interface to a programmable controller;

wherein the programmable controller further comprises a memory storing at least one customizable parameter for operating the power trowel that is selectable by an operator through the graphical user interface; and wherein the at least one customizable parameter comprises at least one of (i) torque of the rotor assemblies and (ii) current supplied to the rotor assemblies.

16. A self-propelled power trowel, for finishing a concrete surface, comprising:

a rigid frame means adapted to be disposed over the concrete surface;

a pair of rotor assemblies each having rotor blades for frictionally contacting the concrete surface and supporting the rigid frame means thereabove, wherein the pair of rotor assemblies are configured to move the power trowel in a forward and a reverse direction; and a user input display mounted to the rigid frame and viewable by a local operator while operating the power trowel, the user input display configured to display a video signal received from a rear facing video camera;

wherein the user input display comprises a graphical user interface that provides a human interface to a programmable controller;

wherein the programmable controller further comprises a memory storing at least one customizable parameter for operating the power trowel that is selectable by an operator through the graphical user interface; and wherein the at least one customizable parameter comprises at least one of (i) speed of the rotor assemblies and (ii) current supplied to the rotor assemblies.

17. A self-propelled power trowel, for finishing a concrete surface, comprising:

a rigid frame means adapted to be disposed over the concrete surface;

a pair of rotor assemblies each having rotor blades for frictionally contacting the concrete surface and supporting the rigid frame means thereabove, wherein the pair of rotor assemblies are configured to move the power trowel in a forward and a reverse direction; and a user input display mounted to the rigid frame and viewable by a local operator while operating the power trowel, the user input display configured to display a video signal received from a rear facing video camera;

wherein the user input display comprises a graphical user interface that provides a human interface to a programmable controller;

wherein the programmable controller further comprises a memory storing at least one customizable parameter for operating the power trowel that is selectable by an operator through the graphical user interface; and wherein the at least one customizable parameter comprises at least one of (i) voltage supplied to the rotor assemblies and (ii) torque of the rotor assemblies.

* * * * *